US011225751B2

(12) United States Patent
Park et al.

(10) Patent No.: US 11,225,751 B2
(45) Date of Patent: Jan. 18, 2022

(54) LAUNDRY TREATING APPARATUS

(71) Applicant: LG Electronics Inc., Seoul (KR)

(72) Inventors: Juhyeong Park, Seoul (KR); Dongwon Kang, Seoul (KR); Hobin Nam, Seoul (KR)

(73) Assignee: LG Electronics Inc., Seoul (KR)

( * ) Notice: Subject to any disclaimer, the term of this patent is extended or adjusted under 35 U.S.C. 154(b) by 168 days.

(21) Appl. No.: 16/779,027

(22) Filed: Jan. 31, 2020

(65) Prior Publication Data

US 2020/0248373 A1 Aug. 6, 2020

(30) Foreign Application Priority Data

Feb. 1, 2019 (KR) ..... 10-2019-0014086
Apr. 11, 2019 (KR) ..... 10-2019-0042660

(51) Int. Cl.

| | |
|---|---|
| ***D06F 39/02*** | (2006.01) |
| ***D06F 37/06*** | (2006.01) |
| ***D06F 37/22*** | (2006.01) |
| *D06F 39/08* | (2006.01) |

(52) U.S. Cl.

CPC ..... *D06F 39/02* (2013.01); *D06F 37/06* (2013.01); *D06F 37/22* (2013.01); *D06F 39/088* (2013.01)

(58) Field of Classification Search

CPC ..... D06F 39/02; D06F 39/088; D06F 37/06; D06F 37/22

USPC ..... 68/17 R

See application file for complete search history.

(56) References Cited

U.S. PATENT DOCUMENTS

2009/0229314 A1 9/2009 Yoo et al.

FOREIGN PATENT DOCUMENTS

| | | |
|---|---|---|
| DE | 102016118334 | 11/2017 |
| EP | 3358065 | 8/2018 |
| WO | WO2003044256 | 5/2003 |

OTHER PUBLICATIONS

WO2003044256A1—machine translation (Year: 2003).*

Extended European Search Report in European Application No. 20152455.0, dated May 29, 2020, 9 pages.

* cited by examiner

*Primary Examiner* — Tinsae B Ayalew

(74) *Attorney, Agent, or Firm* — Fish & Richardson P.C.

(57) ABSTRACT

A laundry treating apparatus includes: a cabinet, a water tank provided inside the cabinet, and a detergent box provided in communication with the water tank to supply detergent to an inside of the water tank. The detergent box includes: a housing in communication with the water tank; a drawer received inside the housing; and a ventilation portion formed through the housing so as to allow an inside of the tank to communicate with an outside of the housing, and the ventilation portion includes a through hole formed through a side surface of the housing, and a protruding groove portion recessed from an inner surface of the housing and protruding from an outer surface thereof and to be open at upper and inner sides thereof, respectively, at a lower side of the through hole. The leakage of wash water through the ventilation portion of the housing may be suppressed.

20 Claims, 15 Drawing Sheets

LAUNDRY TREATING APPARATUS

CROSS-REFERENCE TO RELATED APPLICATIONS

Pursuant to 35 U.S.C. § 119(a), this application claims the benefit of an earlier filing date of and the right of priority to Korean Patent Application No. 10-2019-0014086, filed on Feb. 1, 2019, and Korean Patent Application No. 10-2019-0042660, filed on Apr. 11, 2019, the contents of which are incorporated by reference herein in their entirety.

BACKGROUND

1. Technical Field

The present disclosure relates to a laundry treating apparatus.

2. Description of the Related Art

As is well known, a laundry treating apparatus is a type of apparatus for treating (decontaminating) clothes or laundry through a washing process, a rinsing process and/or a dehydration process. The laundry treating apparatus may also be configured to have a drying function of drying laundry after the washing process, the rinsing process and/or the dehydration process. The laundry includes washable items such as bedding like comforters, curtains, rag dolls, and the like.

The laundry treating apparatus includes a cabinet, a water tank provided inside the cabinet, and a rotating water tank (drum) rotatably provided inside the tub. The cabinet is provided with a detergent box to supply detergent into the water tank. The detergent box is configured to include a housing provided in the cabinet and a drawer withdrawably received with respect to the housing.

A detergent receiving (storage) space is disposed inside the drawer. The detergent receiving space may include, for example, a main detergent receiving portion in which main detergent used during main wash is received, a pre-detergent receiving portion in which pre-detergent used during pre-wash is received, and a fabric softener receiving portion in which fabric softener is received.

An upper side of the drawer is provided with a dispensing unit for dispensing wash water to each detergent space of the drawer. A rear end of the dispensing unit is connected to a wash water supply passage to allow wash water to flow in.

The housing has a upwardly open cylindrical shape. A front region of the housing is open to receive the drawer in a forward and backward movable manner. A bottom portion of the housing is connected to a wash water supply pipe, one end of which is connected to the water tank. Wash water, detergent, fabric softener, and the like are supplied into the water tank through the wash water supply pipe.

On the other hand, a side surface of the housing is disposed with a ventilation portion for allowing an inside and an outside of the water tank to communicate with each other when the drawer is received. Such a ventilation portion functions as a so-called "respiratory pore" for allowing an infant or animal to breathe when the door is closed in a state where a small-sized infant or animal (pet) enters into the tub (actually the drum).

The ventilation portion is formed through a side surface portion of the housing corresponding to a lower side of the drawer not to block the ventilation portion by the drawer when the drawer is received.

However, in such a laundry treating apparatus in the related art, there is a problem that part of wash water supplied from the dispensing unit may be leaked to an outside of the housing through the ventilation portion when the drawer is withdrawn unintentionally while the wash water is supplied through the dispensing unit to supply detergent.

Since the housing of the detergent box is disposed inside the cabinet so as to be visually blocked, it is difficult for a user to recognize the leakage of wash water through the ventilation portion even if leakage occurs, and there is a problem that an action of removing the leaked wash water at the right time or the like may be insufficient.

In particular, the wash water leaking and dropping through the ventilation portion of the detergent box may be mixed with contaminants such as dust in a bottom region inside the cabinet to multiply bacteria, mold, and the like, and may cause an odor (bad smell).

SUMMARY

Therefore, an aspect of the present disclosure is to provide a laundry treatment apparatus capable of suppressing the leakage of wash water through the ventilation portion of the housing.

Furthermore, another aspect of the present disclosure is to provide a laundry treatment apparatus capable of allowing wash water dropping to an outside of the housing through the ventilation portion to flow again into the housing.

In addition, still another aspect of the present disclosure is to provide a laundry treatment apparatus capable of guiding wash water to flow into the inside by blocking the wash water scattered to the outside through the ventilation portion inside the housing.

In order to solve the foregoing problems, a laundry treating apparatus according to the present disclosure is technically characterized in including a through hole that communicates between an inside and an outside of a detergent box and a ventilation portion having a protruding groove portion that protrudes outward and opens upward to communicate with the inside at a lower side of the through hole.

More specifically, the detergent box may include a housing communicating with a water tank, the through hole may be formed through a side surface of the housing, and the protruding groove portion may protrude outward at a lower side of the through hole and upper and inner sides thereof may be open, and thus wash water dropping to an outside of the housing through the through hole may drop into the protruding groove portion and move into the housing, thereby reducing the external leakage of the wash water through the ventilation portion.

The laundry treating apparatus may include a cabinet defining an appearance and a water tank provided inside the cabinet.

The cabinet may be provided with the detergent box, and the detergent box may include a housing communicating with the water tank, and a drawer withdrawably received inside the housing.

A detergent receiving space may be disposed inside the drawer. The detergent receiving space may be implemented as a plurality of compartments.

The protruding groove portion may further protrude to an outside of the housing compared to an upper portion (upper edge) of the through hole.

As a result, part of wash water dropping to an outside of the housing through the through hole may drop into the protruding groove portion to move (flow) into the housing.

The protruding groove portions may further protrude to the outside from both sides of the through hole, respectively.

As a result, part of wash water dropping through the through hole may drop into the protruding groove portion to flow into the housing.

More specifically, the detergent box may include a housing communicating with the water tank; a drawer received inside the housing; and a ventilation portion formed through the housing to allow an inside of the water tank to communicate with an outside of the housing, and the ventilation portion may include a through hole formed through a side surface of the housing, and a protruding groove portion recessed from an inner surface of the housing and protruding from an outer surface thereof and to be open at upper and inner sides thereof, respectively, at a lower side of the through hole.

The ventilation portion may further include a leakage suppression rib protruding to an outside of the housing along an edge of the through hole.

As a result, part of wash water scattered to an outside of the housing through the ventilation portion from an inside of the housing may be blocked to flow into the housing, thereby reducing wash water leaking to an outside of the housing through the ventilation portion.

The housing may include a vertical section in which the drawer is received and an inclined section extending inward from the vertical section in a downwardly inclined manner.

The through hole may be defined such that an upper portion (upper edge) thereof is disposed in a boundary region between the vertical section and an inclined section and a lower portion (lower edge) thereof is disposed in the inclined section.

As a result, it may be possible to suppress the through hole from being blocked by the drawer when the drawer is received into the housing.

The through hole may be implemented in a rectangular shape.

An upper side of the through hole may be disposed in the vertical section and a lower side of the through hole may correspond to the inclined section.

More specifically, since an upper side of the through hole is disposed in the vertical section and a lower side of the through hole corresponds to the inclined section, the lower side of the through hole may be disposed at an inner side than the upper side of the through hole.

The protruding groove portion may include a plurality of side surface portions protruding from an outer surface (inclined section) of the housing and to be vertically spaced apart from each other, and a bottom surface portion blocking a lower end of the plurality of side surface portions.

The plurality of side surface portions may include both side surface portions protruding outward from an outer surface of the housing and a connection portion connecting the both side surface portions.

When both side surface portions have the same protruding length, the connection portion may be disposed in parallel to the vertical section of the housing.

The protruding groove portion may have a "U" cross-sectional shape with a flat cross section that is open to an inside of the housing.

An upper end of the protruding groove portion may be disposed at a position protruding outward from the upper side of the through hole.

As a result, when wash water flowing downward along an inner wall surface of the vertical section of the housing drops from the upper side of the through hole, the wash water may drop into the protruding groove portion.

In addition, an inner width of the upper end of the protruding groove portion may be greater than a length of the upper side of the through hole so that the both side surface portions of the protruding groove portion are disposed outward from both end portions of the upper side of the through hole, thereby allowing wash water dropping from the upper side of the through hole to drop into the protrusion groove portion.

The ventilation portion may be provided with a lower rib protruding from a bottom portion of the through hole to an outside of the housing.

The lower rib may be defined in a rectangular plate shape.

The lower rib may be an embodiment of the leakage suppression rib in that wash water dropping to an outside of the housing through the through hole is blocked and guided to an inside of the housing.

The ventilation portion may be provided with side ribs extending upward from both sides of the lower rib.

The side rib may be an embodiment of the leakage suppression rib in that wash water scattered to an outside of the housing through the through hole is blocked and guided to an inside of the housing.

The ventilation portion may further include an upper rib protruding to an outside of the housing from an upper side of the through hole.

The upper rib may be an embodiment of the leakage suppression rib in that wash water scattered to an outside of the housing through the through hole is blocked and guided to an inside of the housing.

The side rib may extend upward from the upper rib.

The lower rib may further protrude to the outside than the upper rib.

The through hole may be defined in a circular shape.

The ventilation portion may be provided with a lower rib protruding to an outside of the housing from a bottom portion of the through hole and having both sides thereof protruding upward compared to the center.

When the through hole is defined in a circular shape, the lower rib may be configured to have an arc cross-sectional shape.

The through hole may be defined in a hexagonal shape.

The ventilation portion may be provided with a lower rib protruding to an outside of the housing from a bottom portion of the through hole and having both sides thereof protruding in an upwardly inclined manner compared to the center.

When the through hole is defined in a hexagonal shape, the lower rib may correspond to a lower edge of the hexagonal shape.

The lower rib has an upper surface disposed in a downwardly inclined manner to an inside of the housing.

As a result, wash water on an upper surface of the lower rib may move into the housing.

The drawer may be configured to have a plurality of detergent receiving spaces therein.

The detergent box may further include a dispensing unit provided at an upper side of the drawer to dispense wash water to the plurality of detergent receiving spaces.

A through portion may be disposed at a bottom surface portion of the housing, and one end of the wash water supply pipe, the other end of which is connected in communication with the tub, may be connected in communication with the through portion.

As a result, an inside of the water tank may communicate with an inside of the housing, and the inside of the water tank may communicate with an outside of the housing by the ventilation portion.

As described above, according to an embodiment of the present disclosure, the housing of the detergent box may be provided with a ventilation portion, and the ventilation portion may include a through hole formed through the housing and a protruding groove portion recessed from an inner surface of the housing and protruding from the outer surface at a lower side of the through hole, thereby allowing wash water dropping to the outside through the through hole of the housing to drop into the protruding groove portion so as to suppress the leakage of the wash water.

Furthermore, the protruding groove portion may further protrude to the outside than an upper portion of the through hole, thereby more effectively collecting wash water dropping through the through hole therein.

In addition, the protruding groove protruding portion may further protrude to the outside from both sides of the through hole, respectively, thereby more effectively collecting wash water dropping through the through hole therein.

Moreover, the ventilation portion may include a leakage suppression rib protruding to an outside of the housing along an edge of the through hole, thereby effectively blocking and collecting wash water scattered and leaked to the outside through the through hole.

Besides, the ventilation portion may include a lower rib protruding from a bottom portion of the through hole to an outside of the housing, thereby more effectively blocking and collecting wash water dropping to an outside of the housing through the through hole.

Furthermore, the ventilation portion may include side ribs extending upward from both sides of the lower rib, thereby effectively blocking and collecting wash water flowing out to the outside through the through hole.

In addition, the ventilation portion may include an upper rib protruding outward from an upper portion of the through hole, thereby effectively blocking and collecting wash water scattered outward through the through hole.

Moreover, an upper surface of the lower rib may be disposed in a downwardly inclined manner to an inside of the housing, thereby moving wash water at an upper surface of the lower rib into the housing.

Besides, a through portion may be disposed at a bottom portion of the housing, and one end of the wash water supply pipe, the other end of which is connected in connected in communication with the water tank, may be connected in communication with the through portion, thereby allowing an inside of the water tank to communicate with an inside of the housing, and allowing the inside of the water tank to be connected in communication with an outside of the housing.

DETAILED DESCRIPTION OF THE EMBODIMENTS

Figure 1:
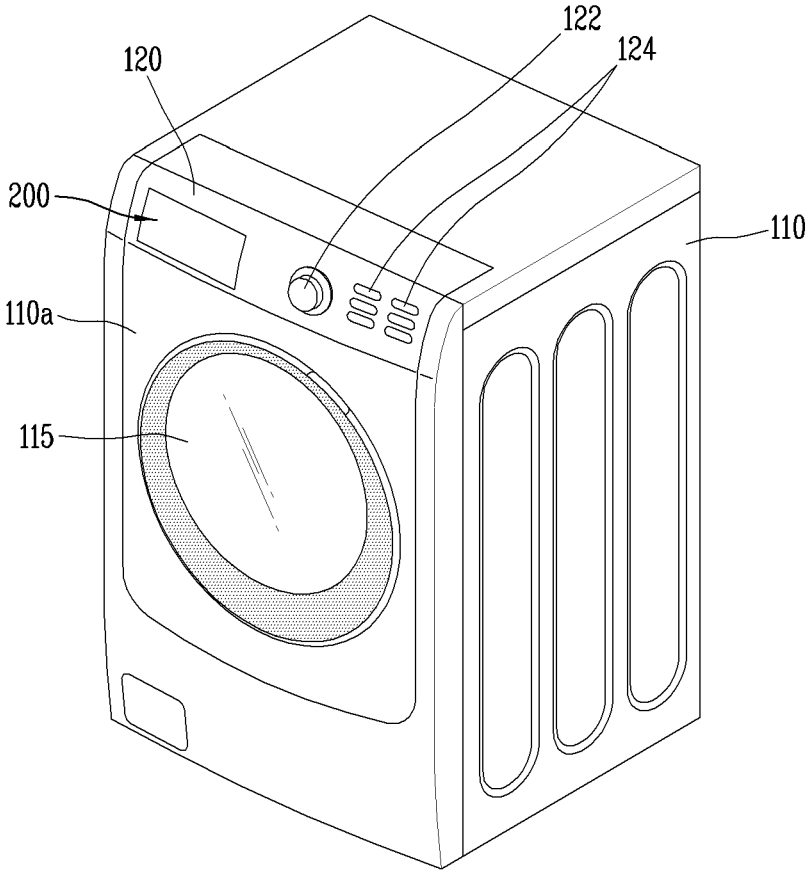
FIG. 1 is a perspective view illustrating a laundry treating apparatus according to an embodiment of the present disclosure.

Hereinafter, embodiments disclosed herein will be described in detail with reference to the accompanying drawings. Even in different embodiments according to the present disclosure, the same or similar reference numerals are designated to the same or similar configurations, and the description thereof will be substituted by the earlier description. Unless clearly used otherwise, expressions in the singular number used in the present disclosure may include a plural meaning. In describing the embodiments disclosed herein, moreover, the detailed description will be omitted when specific description for publicly known technologies to which the invention pertains is judged to obscure the gist of the present disclosure. Also, it should be noted that the accompanying drawings are merely illustrated to easily explain the concept of the invention, and therefore, they should not be construed to limit the technological concept disclosed herein by the accompanying drawings.

Figure 2:
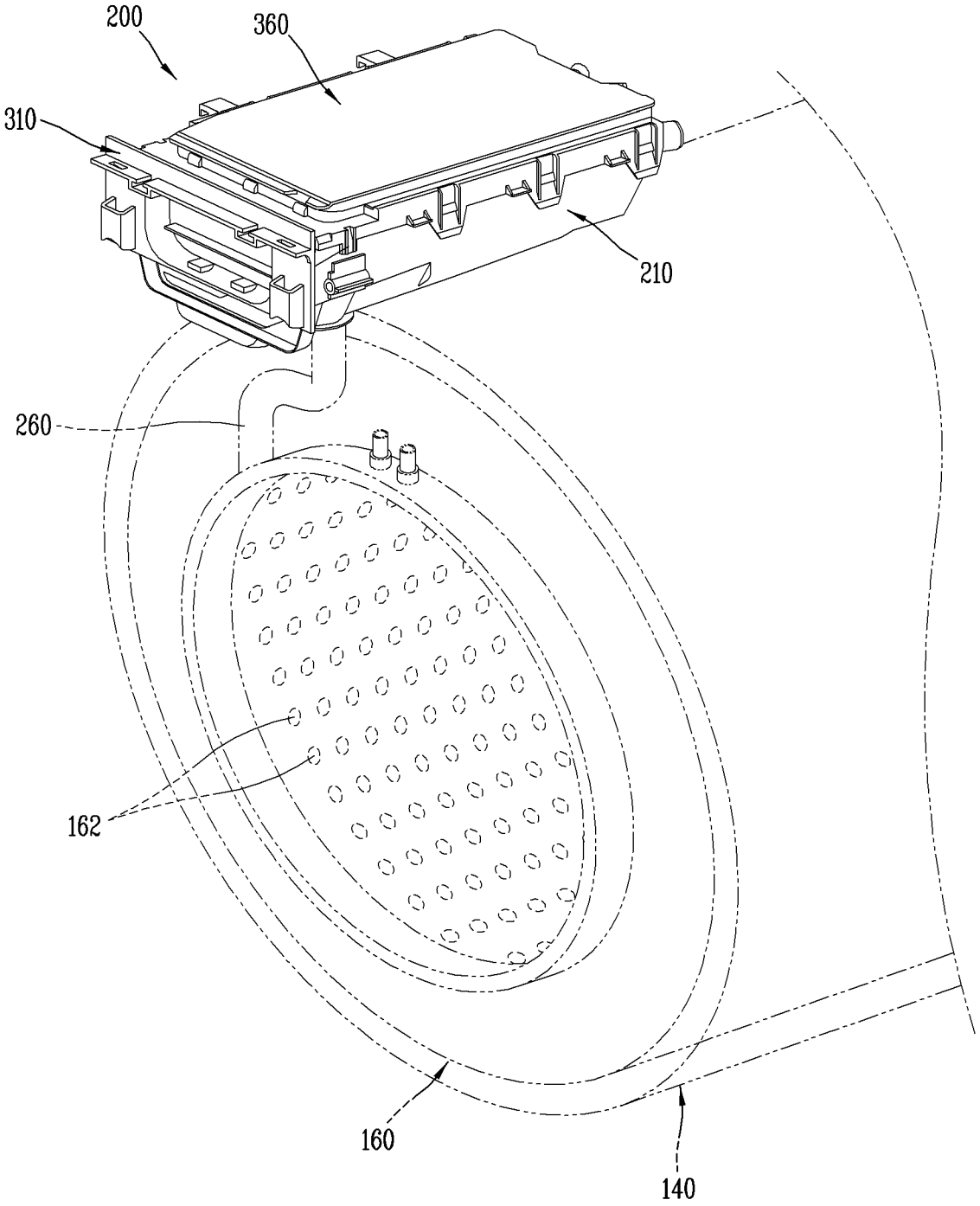
FIG. 2 is a perspective view illustrating a detergent box in FIG. 1.

FIG. 1 is a perspective view illustrating a laundry treating apparatus according to an embodiment of the present disclosure, and FIG. 2 is a perspective view illustrating a detergent box in FIG. 1. As illustrated in FIGS. 1 and 2, a laundry treatment apparatus according to an embodiment of the present disclosure may include a cabinet 110, a water tank 140 and a detergent box 200.

The cabinet 110 is configured to define an appearance. The cabinet 110 has a substantially rectangular parallelepiped shape. A tub or water tank 140 is provided inside the cabinet 110. The water tank 140 defines an receiving space for wash water therein. The water tank 140 has a cylindrical shape with a front opening. The water tank 140 is suspended and supported inside the cabinet 110. The drum 160 is received inside the water tank 140. The drum 160 has a cylindrical shape with a front opening. A circumferential surface of the drum 160 is provided with a plurality of through holes 162. An inside of the drum 160 communicates with an inside of the water tank 140. The drum 160 is rotated about a rotating shaft (not shown) provided at the rear end. A rear end of the water tank 140 is provided with a drive motor (not shown) for rotating the drum 160. The drive motor is connected to the rotating shaft of the drum 160 to drive the drum 160 to rotate forward or forward and reverse.

A front surface (front plate 110*a*) of the cabinet 110 is provided with an opening that allows laundry to enter and exit. The front surface of the cabinet 110 is provided with a door 115 for opening and closing the opening. The door 115 is configured to rotate about the rotating shaft disposed in, for example, a vertical direction. The door 115 is configured to rotate in a left-right direction of the cabinet 110. When the door 115 is opened, a front opening of the cabinet 110, a front opening of the water tank 140, and a front opening of the drum 160 communicate with one another. As a result, laundry is placed into the drum 160, or laundry inside the drum 160 is withdrawn out. The door 115 may be configured to simultaneously block the front opening of the cabinet 110, the front opening of the water tank 140, and the front opening of the drum 160.

An operation panel 120 is provided at a front surface of the cabinet 110 to select an operation mode. The operation panel 120 includes a dial 122 and a plurality of operation buttons 124 for signal input and/or operation manipulation. The cabinet 110 is provided with a detergent box 200 to supply detergent into the water tank 140.

The detergent box 200 is provided with a housing 210, a drawer 310, and a dispensing unit 360.

The housing 210 is fixed to an inside of the cabinet 110. The housing 210 is provided at an upper portion of the water tank 140. More specifically, the housing 210 may be provided at an upper front corner of the cabinet 110 (a left side in the present embodiment). An receiving space is disposed inside the housing 210. The drawer 310 is withdrawably received inside the housing 210. The drawer 310 is withdrawn and received along a front-rear direction of the cabinet 110. A wash water supply pipe 260 is connected to a bottom portion of the housing 210. One end portion of the wash water supply pipe 260 is connected in communication with the water tank 140 and the other end thereof is connected in communication with the housing 210. As a result, an inside of the housing 210 and an inside of the water tank 140 communicate with each other.

Figure 3:
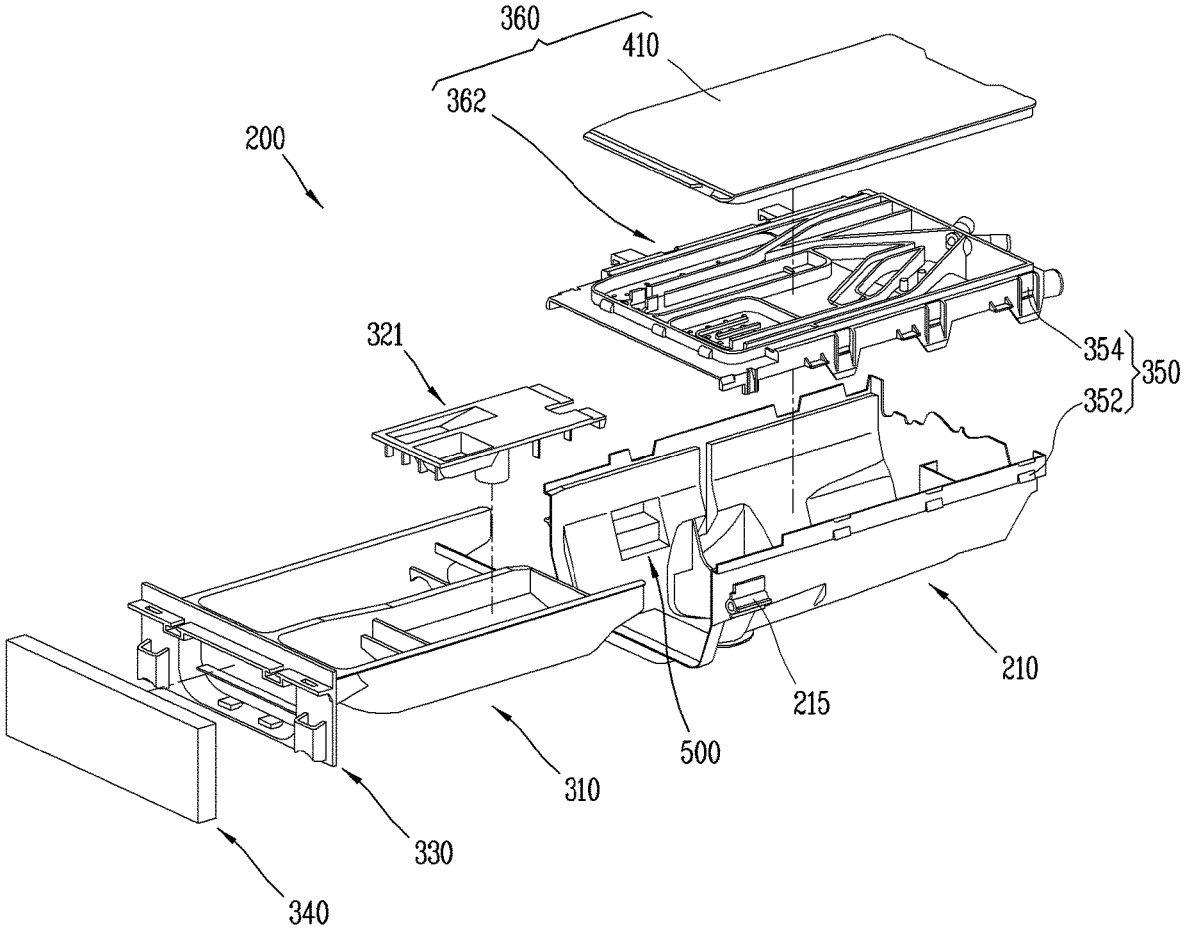
FIG. 3 is an exploded perspective view illustrating the detergent box in FIG. 2.

FIG. 3 is an explosive perspective view illustrating the detergent box 200 in FIG. 2. As illustrated in FIG. 3, the housing 210 has a substantially rectangular parallelepiped shape. The housing 210 is configured such that front and upper sides thereof are open respectively. The drawer 310 is withdrawably received inside the housing 210 along a front-rear direction. One side surface of the housing 210 is provided with a ventilation portion 500 according to an embodiment of the present disclosure to allow an inside and an outside of the housing 210 to communicate with each other.

A detergent receiving space 312 is disposed inside the drawer 310. The detergent receiving space 312 is divided into a plurality of compartments to receive different detergents. The detergent receiving space 312 may include, for example, a main detergent receiving portion 314 in which main detergent is received, a pre-detergent receiving portion 316 in which pre-detergent is received, and a fabric softener receiving portion 318 in which fabric softener is received. Here, the pre-detergent denotes detergent used during pre-wash, and the main detergent denotes detergent used during main wash. The drawer 310 is provided with a siphon forming member 321 for supplying liquid detergent (fabric softener) by a siphon phenomenon. A front blocking portion that blocks a front opening of the housing 210 when the drawer 310 is received inside the housing is disposed on a front surface of the drawer 310. The front blocking portion is provided with a front cover that blocks a front surface of the front blocking portion.

The dispensing unit 360 is configured to supply wash water to the plurality of detergent receiving spaces 312 of the drawer 310, respectively. The dispensing unit 360 includes a dispensing unit body 362 disposed with a plurality of wash water supply passages and an upper cover that blocks an upper region of the dispensing unit body 362. The dispensing unit 360 is coupled to block an upper opening region of the housing 210. The dispensing unit 360 is inserted into and coupled to a predetermined depth into an upper opening of the housing 210 from an upper side of the housing 210. The dispensing unit 360 and the housing 210 are engaged with each other to restrain each other in a vertical direction. An engagement coupling portion is provided in a mutual contact region between the dispensing unit 360 and the housing 210. The engagement coupling portion includes a notch projection protruding from either one of mutual contact surfaces between the dispensing unit 360 and the housing 210, and a notch projection receiving portion receiving the notch projection in the other one of the mutual contact surfaces. The notch projection is implemented by a substantially rectangular shaped protrusion. The notch projection receiving portion is implemented in a rectangular shape corresponding to a shape of the notch projection. In the present embodiment, it is illustrated that the notch projection is disposed on an outer surface of the housing 210, and the notch projection receiving portion is disposed in the dispensing unit 360, but this is merely an example, and the present disclosure is not limited thereto.

Figure 4:
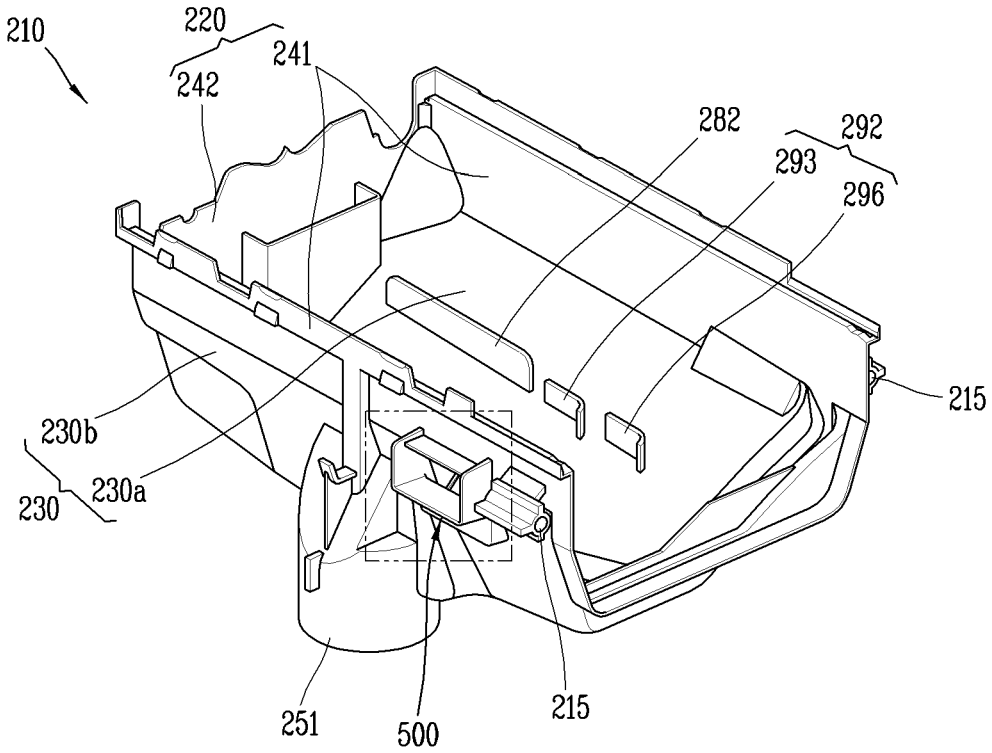
FIG. 4 is a perspective view illustrating a housing in FIG. 3.
Figure 5:
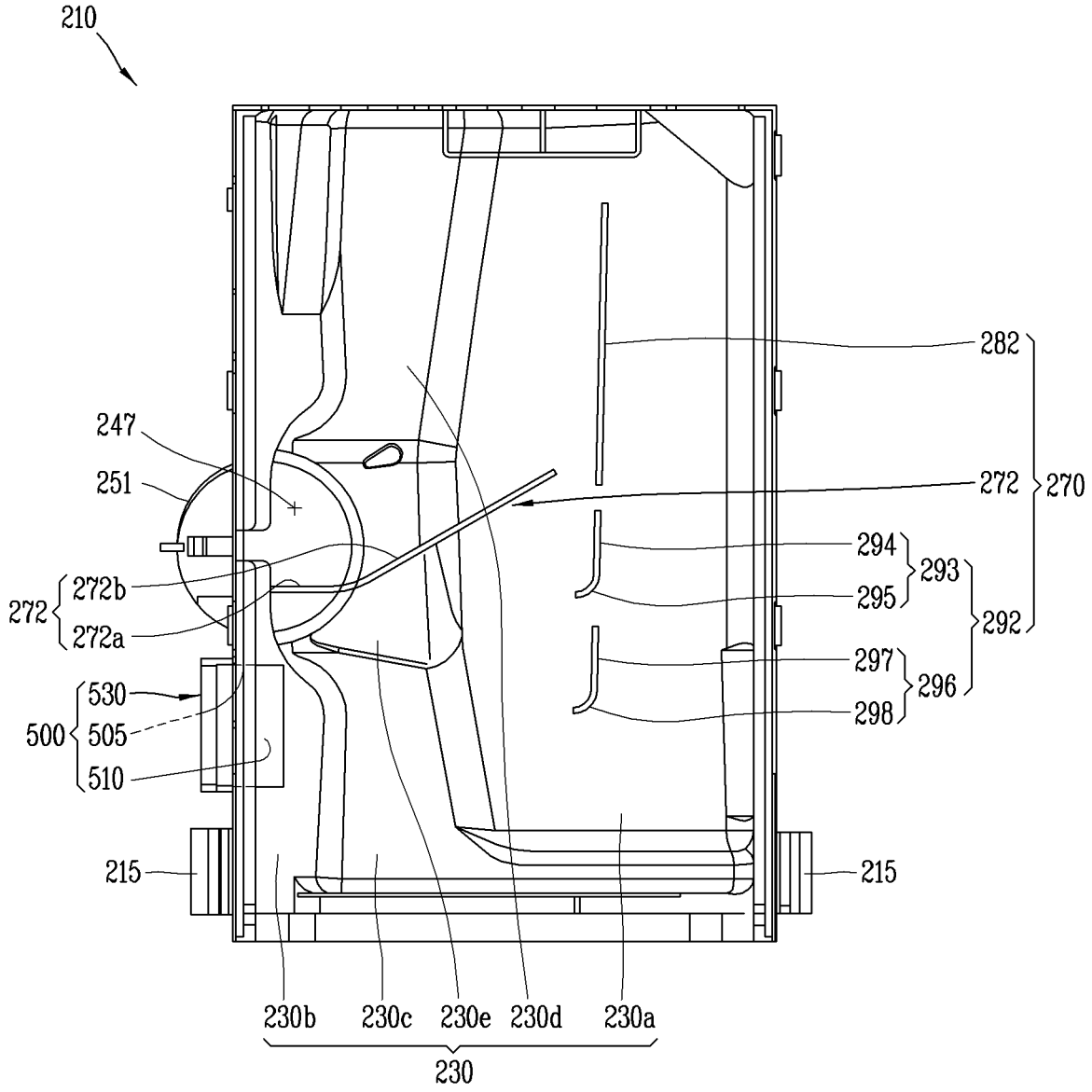
FIG. 5 is a plan view illustrating the housing in FIG. 3.

FIG. 4 is a perspective view illustrating the housing 210 in FIG. 3, and FIG. 5 is a plan view illustrating the housing 210 in FIG. 3. As illustrated in FIGS. 4 and 5, the housing 210 has a cylindrical shape in which upper and front sides thereof are open respectively. The housing 210 is disposed at an inner side of a front plate of the cabinet 110. Screw fastening portions are disposed on both outer surfaces of the housing 210, respectively, to be fastened by the front plate and the screw. Each of the screw fastening portions is provided with a female screw portion to be screw-coupled by the screw.

The housing 210 includes a vertical section 220 in which the drawer 310 is received therein and an inclined section 230 extending in a downwardly inclined manner from the vertical section 220 to an inside thereof.

The drawer 310 is received inside the vertical section 220. The vertical sections 220 are disposed at both lateral sides and a rear side of the drawer 310, respectively.

The inclined sections 230 are disposed at a lower side of the drawer 310, respectively.

The housing 210 includes side surface portions 241 disposed at both sides of the drawer 310, a rear surface portion 242 disposed at a rear side of the drawer 310, and a bottom surface portion 245 disposed at a lower side of the drawer 310.

The vertical section 220 includes, for example, the both side surface portions 241 and the rear surface portion 242.

The bottom surface portion 245 includes, for example, the plurality of inclined sections 230*a*, 230*b*, 230*c*, 230*d*, 230*e* disposed at a lower side of the vertical section 2200.

The bottom surface portion 245 is provided with a through portion 247 passing therethrough to allow wash water therein to flow out.

The through portion 247 is disposed at the lowest position of the bottom surface portion of the housing 210.

The plurality of inclined sections include a first inclined section 230*a* and a second inclined section 230*b* which are disposed in a downwardly inclined manner from the side surface portions 241, respectively. The first inclined section 230*a* and the second inclined section 230*b* are respectively disposed in a downwardly inclined manner along a left-right direction of the housing 210 to an inside thereof.

The inclined section includes a third inclined section 230*c* disposed at a front side of the through portion 247, a fourth inclined section 230*d* disposed at a rear side of the through portion 247, and a fifth inclined section 230*e* disposed at a lateral side of the through portion 247. Here, the third inclined section 230*c* and the fourth inclined section 230*d* may be inclined along a front-rear direction of the housing 210. The fifth inclined section 230*e* may be inclined along a left-right direction of the housing 210. The third inclined section 230*c* and the fourth inclined section 230*d* may have a horizontal or slight inclination with respect to a left-right direction of the housing 210, for example. The fifth inclined section 230*e* may be disposed horizontally with respect to a front-rear direction of the housing 210, and may be configured to have a horizontal or slight inclination with respect to a left-right direction of the housing 210. Here, the bottom surface portion 245 may be provided with a plurality of inclined sections inclined toward the through portion 24, thereby efficiently moving detergent and/or wash water to the through portion 247.

The through portion 247 is provided with a wash water supply pipe connection portion 251 to allow one end thereof to be connected in communication with the other end of the wash water supply pipe 260 connected to the water tank 140. The wash water supply pipe connection portion 251 is defined such that one region protrudes to the left side on the drawing along a width direction of the housing 210.

On the other hand, a partition portion 270 is disposed inside the housing 210 to allow detergent supplied from the drawer 310 to be partitioned and supplied. The partition portion 270 includes, for example, a horizontal partition portion 272 that protrudes upward from the bottom surface portion and is disposed horizontally with respect to a movement direction of the drawer 310. The horizontal partition portion 272 is disposed horizontally at an upper side of the through portion 247, and disposed again to be bent in a rearwardly inclined manner. More specifically, the horizontal partition portion 272 is disposed over the fifth inclined section 230*e* and the first inclined section 230*a* from an upper side of the through portion 247. As a result, main detergent and wash water dropping into a rear section of the bottom surface portion of the housing 210 via the main detergent receiving portion 314 of the drawer 310 may be suppressed from being excessively moved to a front section of the bottom surface portion, thereby efficiently being supplied to the through portion 247. The horizontal partition portion 272 includes a first section disposed horizontally at an upper side of the through portion 247, and a second section disposed in a rearwardly inclined manner at an upper side of the fifth inclined section 230*e* and the first inclined section 230*a*, for example.

The partition portion 270 includes a vertical partition portion 282 that protrudes from the bottom surface portion (first inclined section 230*a*) and is disposed along a movement direction of the drawer 310 (a front-rear direction of the housing 210). The vertical partition portion 282 is implemented to have a preset length from a rear region of the bottom surface portion (first inclined section 230*a*) of the housing 210. A rear end portion of the vertical partition portion 282 is spaced apart from a rear end portion of the housing 210 by a preset distance. The vertical partition portion 282 is spaced apart from the horizontal partition portion 272 by a preset distance.

The partition portion 270 includes an extension partition portion 292 spaced apart from the vertical partition portion 282 by a preset distance. The extension partition portion 292 includes a first extension partition portion 293 spaced apart from the vertical partition portion 282 and a second extension partition portion 296 spaced apart from the first extension partition portion 293. The first extension partition portion 293 and the second extension partition portion 296 are respectively configured to have a reduced length compared to the vertical partition portion 282.

The first extension partition portion 293 includes a first body 294 disposed along a movement direction of the drawer 310 and a first bent end portion 295 bent at an end portion of the first body 294.

The second extension partition portion 296 includes a second body 297 disposed along a movement direction of the drawer 310 and a second bent end portion 298 bent at an end portion of the second body 297.

Here, the second extension partition portion 296 may be configured to be disposed at a lower position than the first extension partition portion 293.

Figure 6:
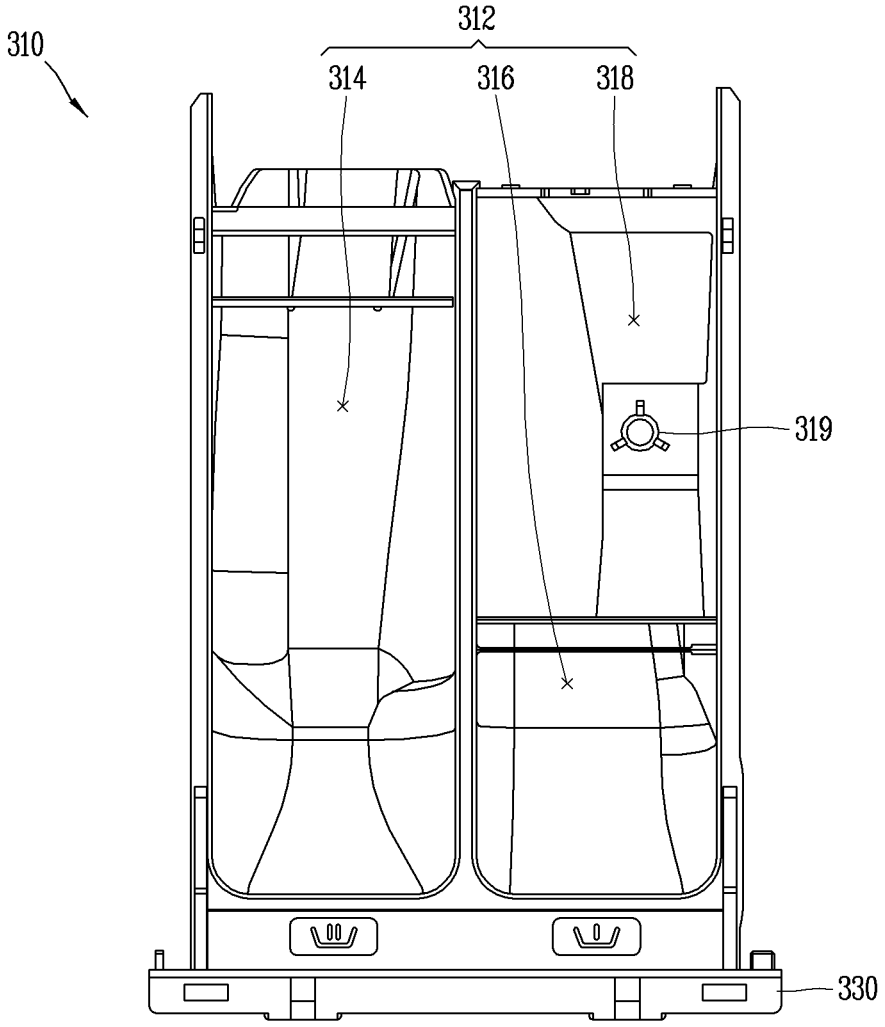
FIG. 6 is a plan view illustrating a drawer in FIG. 2.

FIG. 6 is a plan view illustrating the drawer 310 in FIG. 2. As illustrated in FIG. 6, a plurality of detergent receiving spaces 312 partitioned from each other are provided inside the drawer 310. The detergent receiving space 312 may include a main detergent receiving portion 314 in which main detergent used during main wash is received, a pre-detergent receiving portion 316 in which pre-detergent used during pre-wash is received, and a fabric softener receiving portion 318 in which fabric softener is received.

More specifically, the main detergent receiving portion 314 is disposed at an inner left region of the drawer 310, for example. The pre-detergent receiving portion 316 is disposed in a front region within an inner right region of the drawer 310. The fabric softener receiving portion 318 may be disposed in a rear region within an inner right region of the drawer 310.

The main detergent receiving portion 314 is configured such that detergent and wash water move to the rear region and drop to a rear region of the fourth inclined section 230*d* of the housing 210.

The pre-detergent receiving portion 316 is configured such that detergent and wash water move to a rear region of the drawer 310 and drop to a rear region of the inclined section (first inclined section 230*a*) of the housing 210.

The fabric softener receiving portion 318 is provided with an outlet pipe 319 disposed with a passage through which fabric softener and wash water move downward. The outlet pipe 319 protrudes upward from a bottom surface of the fabric softener receiving portion 318. The siphon forming member 321 is provided with a tubular portion 323 in which the outlet pipe 319 is inserted thereinto and coupled thereto.

The tubular portion 323 protrudes downward at a bottom portion of the siphon forming member 321. The tubular portion 323 is configured to define a path through which wash water moves between the tubular portion 323 and the outlet pipe 319. The fabric softener and wash water flow in between the tubular portion 323 and the outlet pipe 319 and drop to a rear region of the bottom surface portion (first inclined section 230*a*) of the housing through an inside of the outlet pipe 319.

Figure 7:
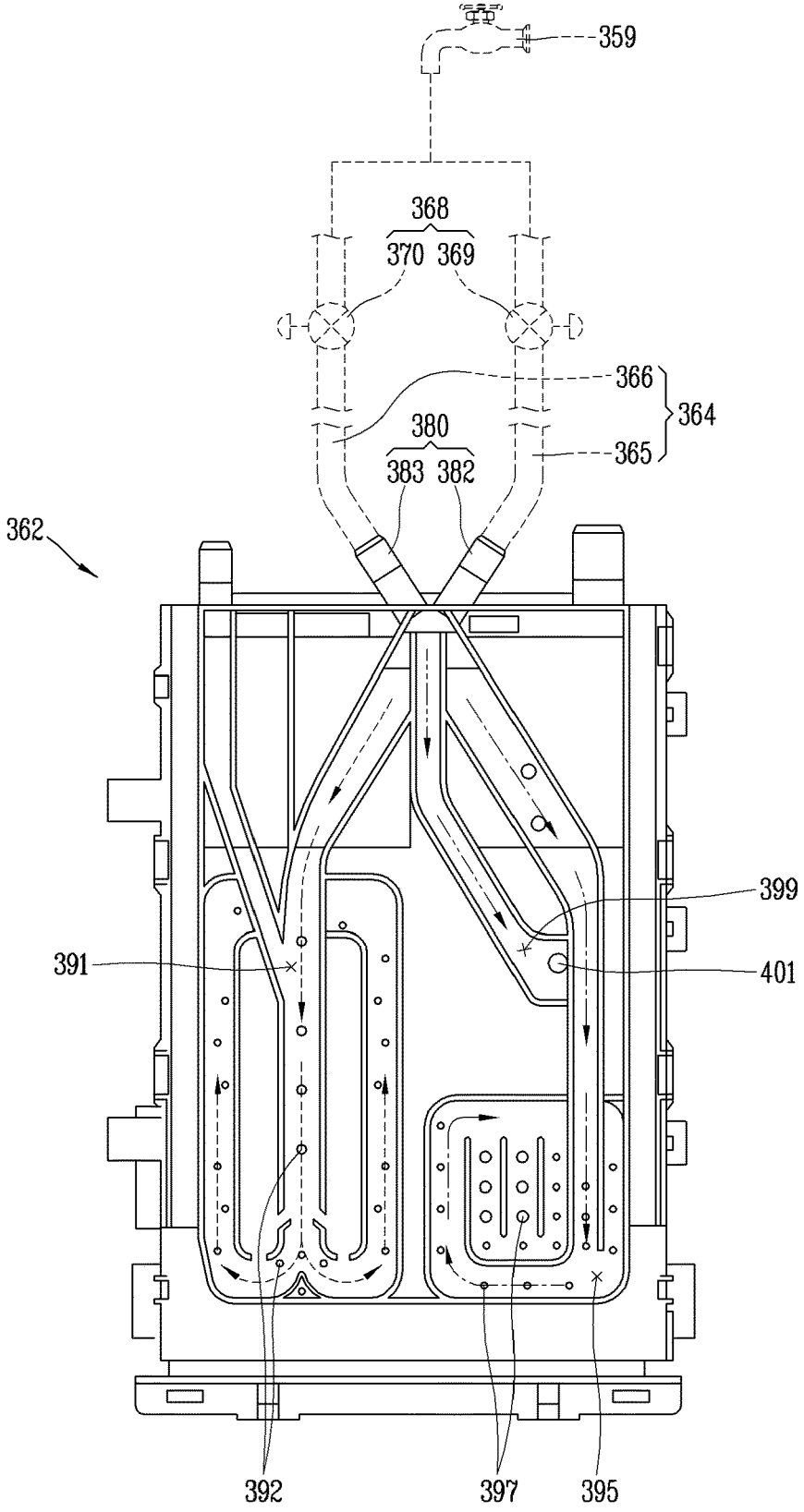
FIG. 7 is a plan view illustrating a dispensing unit body in FIG. 2.

FIG. 7 is a plan view illustrating the dispensing unit body 362 in FIG. 2. As illustrated in FIGS. 3 and 7, the dispensing unit body 362 has a substantially rectangular parallelepiped shape. A rear end portion of the dispensing unit body 362 is connected to a wash water supply passage 364 for supplying wash water.

One end portion of the wash water supply passage 364 is connected to a faucet 359 of running water. The wash water supply passage 364 includes a main wash water supply passage 365 for supplying wash water during main wash and a pre-wash water supply passage 366 for supplying wash water during pre-wash.

The wash water supply passages 364 are respectively opened and closed by water supply valves 368. The water supply valve 368 includes a main valve 369 the opens the main wash water supply passage 365 to supply wash water during main wash and a pre-valve 370 that opens the pre-wash water supply passage 366 to supply wash water during pre-wash.

Wash water supply passage connection portions 380 are respectively provided at a rear end portion of the dispensing unit body 362 to connect the wash water supply passages 364, respectively. The wash water supply passage connecting unit 380 includes a main wash water supply passage connecting unit 382 connected to the main wash water supply passage 365 and a pre-wash water supply passage connecting unit 383 connected to the pre-wash water supply passage 366.

A plurality of wash water movement paths 390 are arranged inside the dispensing unit body 362. The plurality of wash water movement paths 390 includes a main valve supply unit 391 that supplies wash water when the main valve 369 is opened, a pre-valve supply unit 395 that supplies wash water when the pre-valve 370 is opened, and a main/pre-valve supply unit 399 that supplies wash water when the main valve 369 and the pre-valve 370 are opened at the same time.

The main valve supply unit 391 has a relatively large area to supply wash water to the main detergent receiving portion 314 having a relatively large area. The main valve supply unit 391 is provided with a plurality of distribution holes 392. The distribution holes 392 of the main valve supply part 391 are arranged to be spaced apart from each other by a relatively large separation distance.

The pre-valve supply unit 395 is provided with a plurality of distribution holes 397. The distribution holes 397 of the pre-valve supply unit 395 are spaced apart from each other with a relatively small separation distance. The pre-valve supply unit 395 is provided with distribution holes 401 of different sizes.

Figure 8:
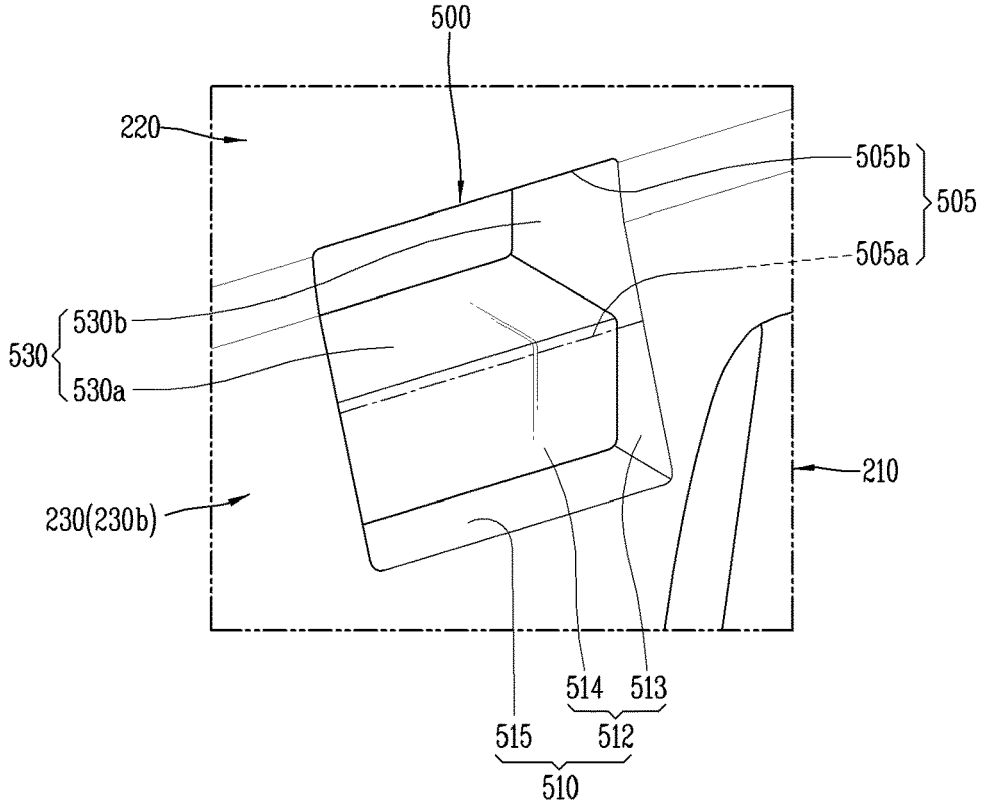
FIG. 8 is an enlarged view illustrating a ventilation portion of the housing in FIG. 3.
Figure 9:
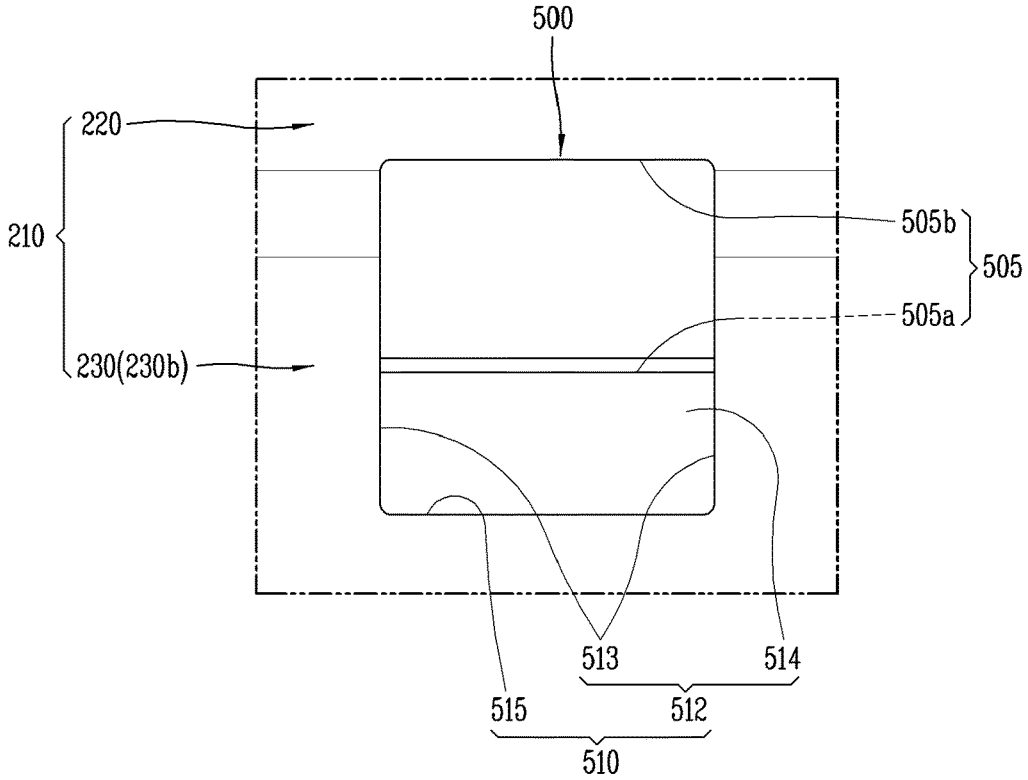
FIG. 9 is a front view illustrating the ventilation portion in FIG. 8.
Figure 10:
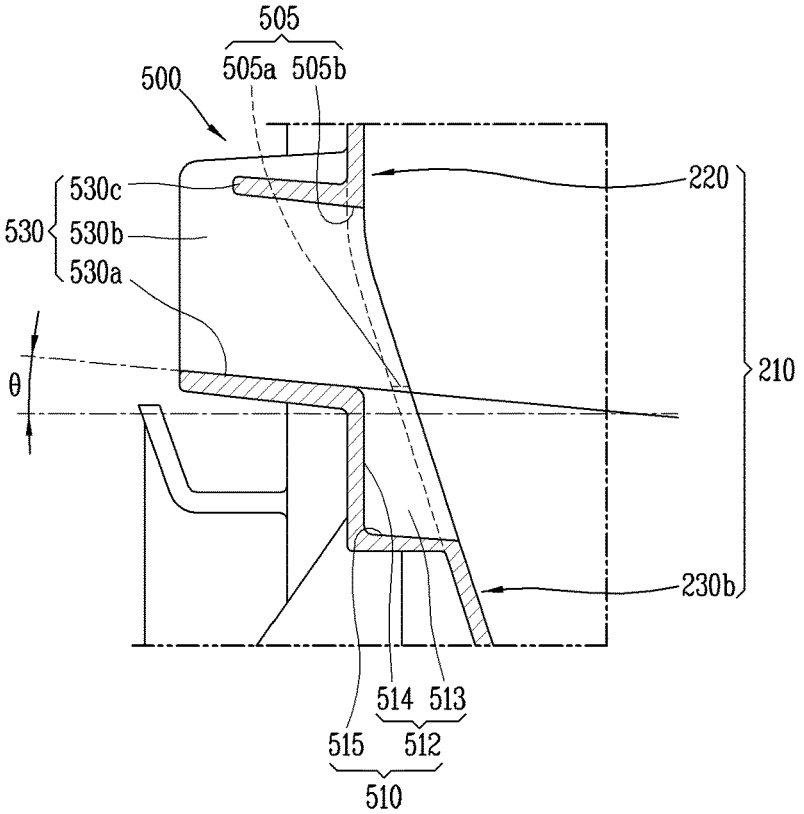
FIG. 10 is a longitudinal sectional view illustrating the ventilation portion in FIG. 8.

FIG. 8 is an enlarged view illustrating a ventilation portion 500 of the housing 210 in FIG. 3, and FIG. 9 is a front view illustrating the ventilation portion 500 in FIG. 8, and FIG. 10 is a longitudinal sectional view illustrating the ventilation portion 500 in FIG. 8. As illustrated in FIGS. 8 through 10, the housing 210 includes a vertical section 220 and an inclined section (second inclined section 230*b*) inclined inwardly from the vertical section 220.

The ventilation portion 500 according to an embodiment of the present disclosure is disposed at one side of the housing 210. In the present embodiment, it is illustrated that the ventilation portion 500 is provided at a left side of the housing 210 on the drawings, but this is merely an example, but present disclosure is not limited thereto. The ventilation portion 500 may be disposed at a right side of the housing 210 on the drawings.

The ventilation portion 500 includes a through hole 505 formed therethrough in a boundary region between the vertical section 220 and the inclined section 230 (second inclined section 230*b*) and a protrusion groove portion 510 recessed from an inner surface of the through hole 505 and protruding from an outer surface thereof.

As a result, an inside and an outside of the housing 210 communicate with each other by the ventilation portion 500. Accordingly, an inside of the water tank 140 and an outside of the housing 210 communicate with each other. According to this configuration, even when the door 115 is closed after an infant or animal enters into the drum 160 through a front opening of the cabinet 110, the water tank 140 may communicate with an outside of the housing 210 through the ventilation portion 500, thereby allowing the infant or animal to breathe.

The through hole 505 is defined in a rectangular shape, for example. More specifically, an upper side 505*b* of the through hole 505 is disposed in the vertical section 220, and a lower side 505*a* of the through hole 505 is disposed in the inclined section (second inclined section 230*b*).

The protruding groove portion 510 includes a plurality of side surface portions 512 extending downward from a lower side of the through hole 505 and a bottom surface portion 515 blocking a lower end of the plurality of side surface portions 512. The plurality of side surface portions 512 include both side surface portion 513 protruding from an outer surface of the housing 210 and a connection portion 514 connecting the both side surface portions 513. Here, it is illustrated that the plurality of side surface portions 512 are disposed vertically in an up-down direction of the housing 210, but this is merely an example, and the present disclosure is not limited thereto. The upper ends of the plurality of side surface portions 512 may respectively further protrude to an outside of the housing and disposed in a downwardly inclined manner to the inside than the lower end thereof.

The protruding groove portion 510 has a "U" cross-sectional shape that is open toward an inside of the housing 210. An upper side of the protruding groove portion 510 is open. The bottom surface portion 515 blocks the lower ends of both side surface portions 513 and the connection portion 514. As a result, wash water dropping from an upper side of the through hole 505 may drop into the protruding groove portion 510 and move into the housing 210 along the bottom surface portion 515. Here, the bottom surface portion 515 of the protruding groove portion 510 may be disposed in a downwardly inclined manner to an inside of the housing 210.

In the present embodiment, a lower side of the through hole 505 is not clearly shown in the drawing by the formation of the protruding groove portion 510, but may be shown as an imaginary line 505*a* connecting a point at which an extension line extending along a horizontal direction from an upper end of the protruding groove portion 510 and an inclined section 230 (second inclined section 230*b* in the present embodiment) of the housing 210 meet each other, for example.

An upper end of the protruding groove portion 510 may correspond to a lower side of the upper side of the through hole 505. The upper end of the protruding groove portion 510 may further protrude to the outside than the upper side of the through hole 505 so as to allow wash water dropping from the upper side of the through hole 505 to drop to the inside. As a result, the leakage of wash water dropping to an outside of the housing 210 through the through hole 505 may be reduced.

Figure 11:
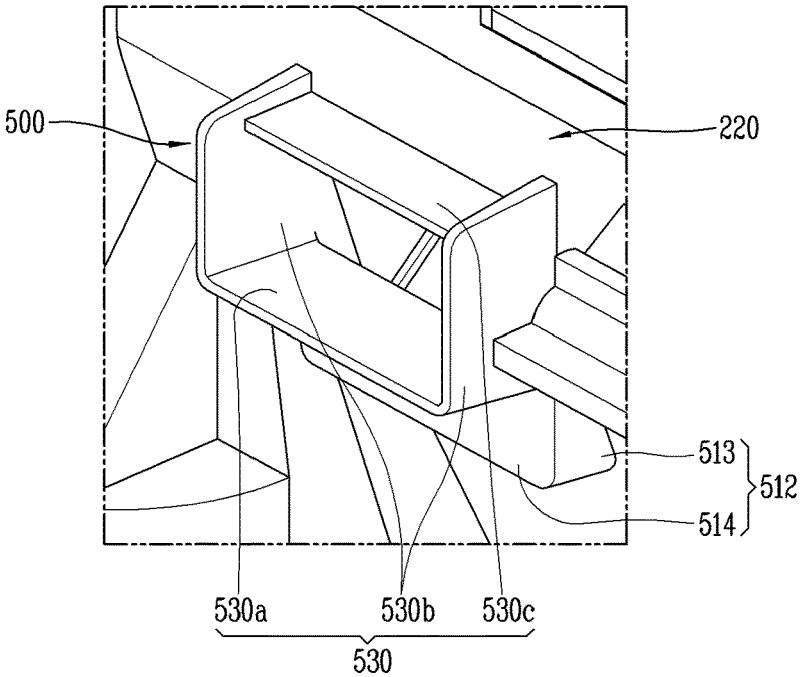
FIG. 11 is an enlarged view illustrating a ventilation portion of the housing in FIG. 4.
Figure 12:
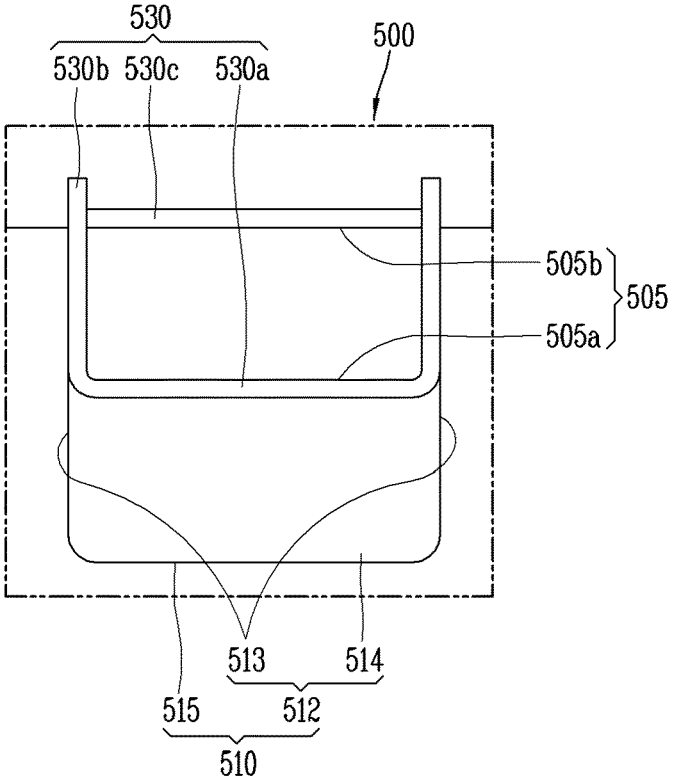
FIG. 12 is a front view illustrating the ventilation portion in FIG. 11.
Figure 13:
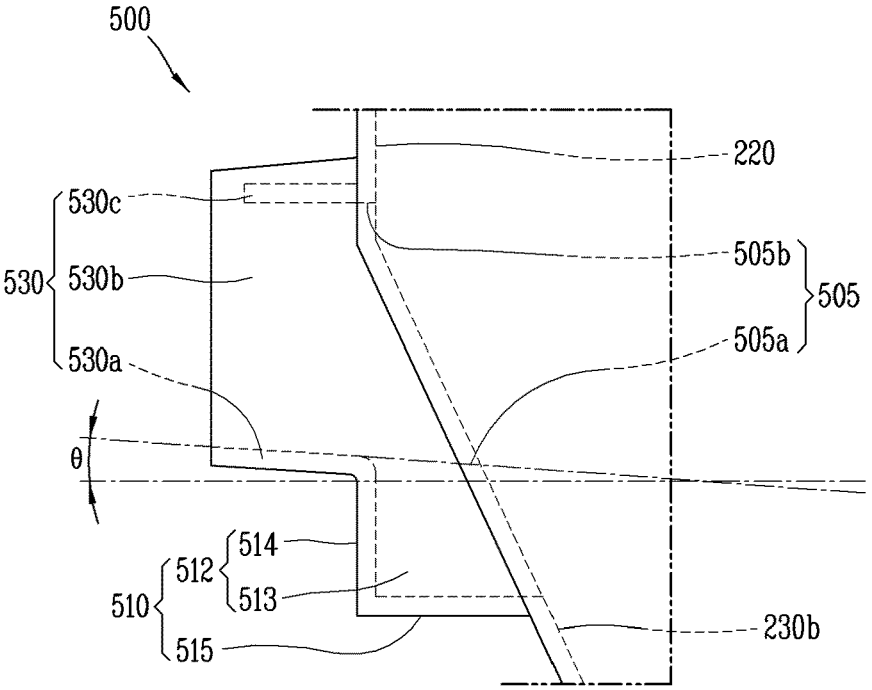
FIG. 13 is a side view illustrating the ventilation portion in FIG. 12.

FIG. 11 is an enlarged view illustrating the ventilation portion 500 of the housing 210 in FIG. 4, and FIG. 12 is a front external view illustrating the ventilation portion 500 in FIG. 11, and FIG. 13 is a side view illustrating the ventilation portion 500 in FIG. 12. As illustrated in FIG. 11, the ventilation portion 500 includes a leakage suppression rib 530 protruding to an outside of the housing 210 along an edge of the through hole 505. As a result, part of wash water scattered to an outside of the housing 210 through the ventilation portion 500 from an inside of the housing 210 may be blocked to flow into the housing 210, thereby reducing wash water leaking to the outside through the ventilation portion 500.

In the present embodiment, it is illustrated a case where the through hole 505 is implemented in a rectangular shape, and the leakage suppression rib 530 is disposed along an edge of the through hole 505, but this is merely an example, and the present disclosure is limited thereto.

As illustrated in FIGS. 11 and 12, the leakage suppression rib 530 includes a lower rib 530*a* protruding to the outside from a lower side of the through hole 505.

The lower rib 530*a* is formed in a rectangular plate shape. The lower rib 530*a* is disposed in a downwardly inclined manner to an inside of the housing 210.

The lower rib 530*a* is disposed in a downwardly inclined manner to an inside of the housing 210 with a preset inclination angle (θ) with respect to a horizontal line in parallel to the bottom surface on which the laundry treating apparatus is provided.

Here, the lower rib 530*a* may also be configured to protrude horizontally from an outer surface of the housing 210 such that the upper surface is inclined with a preset inclination angle (θ) with respect to the horizontal line.

As a result, wash water dropping to the outside through the through hole 505 from an inside of the housing 210 may be blocked by the lower rib 530*a*, and moved into the housing 210 along the lower rib 530*a*.

The ventilation portion 500 has side ribs extending upward from both sides of the lower rib 530*a*. The leakage suppression rib 530 may be configured to include the side ribs.

The side ribs may extend higher than an upper side of the through hole 505. The side ribs may block the movement of wash water scattered from an inside of the housing 210 to the outside through the through hole 505 to reduce the external leakage of wash water.

The ventilation portion 500 includes an upper rib protruding to the outside from an upper side of the through hole 505. The leakage suppression rib 530 may include the upper rib.

The upper rib may block wash water scattered to an outside of the housing 210 through the through hole 505 to reduce the leakage of wash water through the through hole 505.

The lower rib 530*a* is configured to further protrude to the outside than the upper rib. According to this, wash water dropping from the upper rib may drop to an upper surface of the lower rib 530*a*, and move into the housing 210 along the lower rib 530*a*. As a result, the external leakage of wash water through the ventilation portion 500 may be suppressed.

As illustrated in FIG. 13, the side rib further extends upward than the upper rib. Since the side rib has the same protruding length as that of the lower rib 530*a*, the side rib further protrudes to an outside of the housing 210 than the upper rib. The protruding groove portion 510 is disposed at a lower side of the lower rib 530*a*. Both side surface portions of the protruding groove portion 510 have a substantially triangular shape.

By this configuration, the dispensing unit 360 is coupled to an upper side of the housing 210. Wash water supply passages are respectively connected to the housing 210. The drawer 310 is received in the housing 210, and the housing 210 is received in the cabinet 110 and a screw is fastened and fixed to the screw fastening portion.

Main detergent, pre-detergent and fabric softener are respectively received in the relevant detergent receiving space 312 inside the drawer 310.

When wash water is supplied to the relevant region through the dispensing unit 360, detergent and wash water received in the relevant region drop into the relevant detergent supply region of the housing 210. The dropped detergent and wash water are provided into the water tank 140 through the wash water supply pipe 260.

On the other hand, when the drawer 310 is withdrawn unintentionally while wash water is supplied to the relevant region through the dispensing unit 360, wash water flowing out of the dispensing unit 360 may drop along an inner surface of the housing 210. Part of wash water dropping to an inner surface of the housing 210 may drop to an outside of the housing 210 through the through hole 505. The wash water dropped to the outside of the housing 210 through the through hole 505 flows again into the housing 210 by the lower rib 530*a*. As a result, the external leakage of wash water through the ventilation portion 500 may be reduced.

When an external force acts on the housing 210, part of wash water inside the housing 210 may be scattered and thus scattered to an outside of the housing 210 through the through hole 505.

Part of wash water scattered to an outside of the housing 210 through the through hole 505 may be blocked by the leakage suppression rib 530 (the lower rib 530*a*, the side ribs and the upper rib) to drop to the lower side and move into the housing 210 along the lower rib 530*a*. As a result, wash water scattered and leaked to the outside through the ventilation portion 500 may be reduced.

On the other hand, when an infant or animal enters into the drum 160 through a front opening of the cabinet 110, and the door 115 is closed to block the opening, the water tank 500 may communicate with an outside of the housing 210 through the ventilation portion 140 of the housing 210, thereby allowing the infant or animal to breathe.

Figure 14:
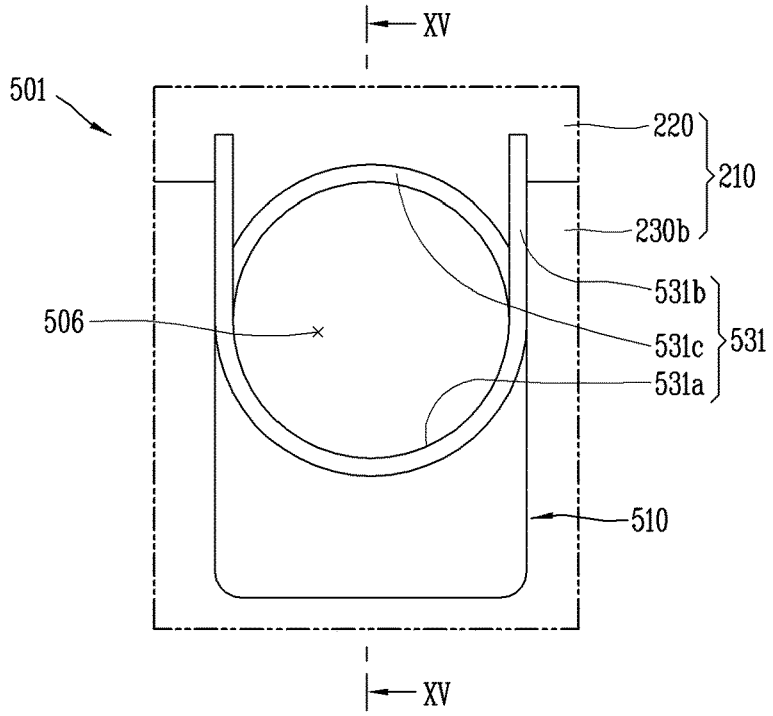
FIG. 14 is an internal front view illustrating a ventilation portion of a housing in a laundry treating apparatus according to another embodiment of the present disclosure.
Figure 15:
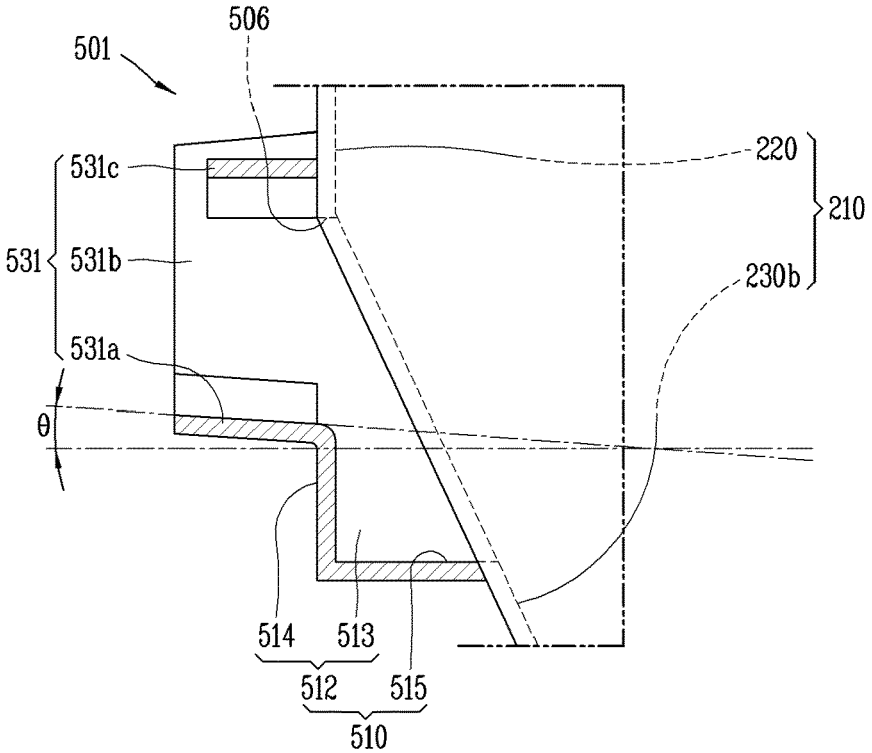
FIG. 15 is a longitudinal sectional view illustrating the ventilation portion in FIG. 14.

FIG. 14 is an internal front view illustrating a ventilation portion 501 of the housing 210 in a laundry treating apparatus according to another embodiment of the present disclosure, and FIG. 15 is a longitudinal sectional view illustrating the ventilation portion 501 in FIG. 14. As described above, the laundry treatment apparatus of the present embodiment includes a cabinet 110, a water tank 140, and a detergent box 200.

The detergent box 200 of the present embodiment includes a housing 210, a drawer 310, and a dispensing unit 360.

The housing 210 is connected in communication with the water tank 140 by the wash water supply pipe 260.

One side of the housing 210 is provided with a ventilation portion 501. The ventilation portion 501 includes a through hole 506 formed through the housing 210 and a protruding groove portion 510 that protrudes to the outside and communicates with the inside at a lower side of the through hole 506.

The protruding groove portion 510 has a shape in which upper and inner sides thereof are open. As a result, the protruding groove portion 510 collects wash water dropping from the through hole 506 and move the collected wash water to an inside of the housing 210.

The through hole 506 is implemented in a circular shape, as illustrated in FIG. 14.

The ventilation portion 501 includes a leakage suppression rib 531 protruding from an outer surface of the housing 210 along an edge of the through hole 506.

The ventilation portion 501 has a lower rib 531*a* protruding to an outside of the housing 210 along a lower edge of the through hole 506. The leakage suppression rib 531 is configured to include the lower rib 531*a*. The lower rib 531*a* is implemented in an arc shape. The lower rib 531*a* is defined in an arc shape in which the center thereof protrudes downward. As illustrate in FIG. 15, the lower rib 531*a* may be inclined at a preset inclination angle (θ) with respect to a horizontal line.

The ventilation portion 501 includes side ribs 531*b* extending upward from both sides of the lower rib 531*a*. The side ribs 531*b* are implemented to have the same protruding length (protruding width) as the lower ribs 531*a*.

The ventilation portion 501 has an upper rib 531*c* protruding an outside of the housing 210 along an upper edge of the through hole 506. The upper rib 531*c* may be defined in an arc shape. The upper rib 531*c* is configured to have an arc shape in which the center thereof protrudes upward.

As illustrated in FIG. 15, the lower rib 531*a* (side rib 531*b*) is configured to further protrude the outside from an outer surface of the housing 210 than the upper rib 531*c*.

Referring to FIG. 14, the side rib 531*b* is configured to protrude upward from the upper rib 531*c*.

Figure 16:
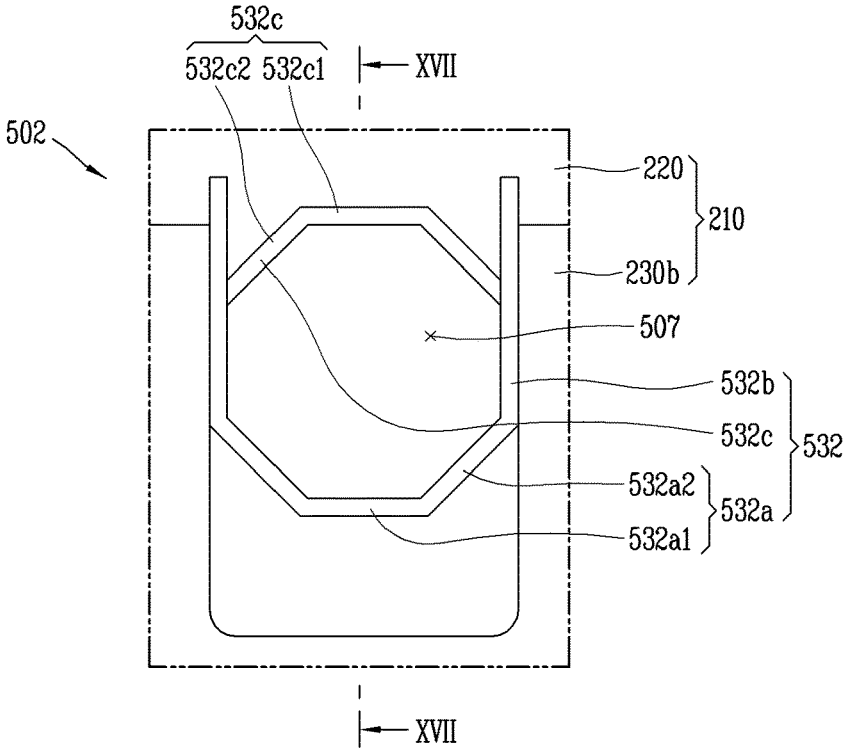
FIG. 16 is an internal front view illustrating a ventilation portion of a housing in a laundry treating apparatus according to still another embodiment of the present disclosure.
Figure 17:
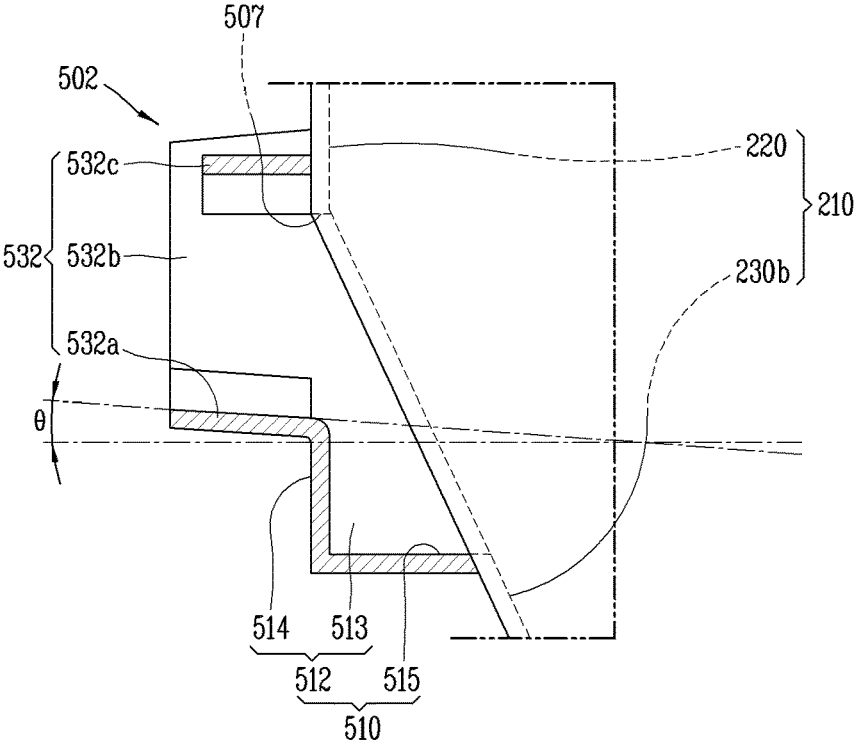
FIG. 17 is a longitudinal sectional view illustrating the ventilation portion in FIG. 16.

FIG. 16 is an internal front view illustrating a ventilation portion of the housing 210 in a laundry treating apparatus according to still another embodiment of the present disclosure, and FIG. 17 is a longitudinal sectional view illustrating the ventilation portion in FIG. 16. As described above, a ventilation portion 502 of the present embodiment includes a through hole 507 formed through the housing 210 and a protruding groove portion 510 that protrudes to the outside and communicates with the inside at a lower side of the through hole 507.

The through hole 507 of the present embodiment has a hexagonal shape, as illustrated in FIG. 16.

The protruding groove portions 510 that are open to the upper and inner sides of the housing 210, respectively, are provided at a lower side of the through hole 507. As a result, the protruding groove portion 510 collects wash water dropping from the through hole 507 to move the wash water to an inside of the housing 210.

The ventilation portion 502 of the present embodiment has a leakage suppression rib 532 protruding the outside along an edge of the through hole 507.

As illustrated in FIG. 17, the ventilation portion 502 includes a lower rib 532*a* that protrudes the outside from a lower portion of the through hole 507. For example, the lower rib 532*a* includes a bottom surface portion 532*a*1 extending to the outside from a lower side disposed at the lowest side of the through hole 507 and inclined portions 532*a*2 extending in an outwardly inclined manner to correspond to sides connected to both sides of the lower side, respectively. The lower rib 532*a* is disposed in a downwardly inclined manner to the inside with a preset inclination angle (θ) with respect to a horizontal line.

The ventilation portion 502 has side ribs 532*b* extending upward at both sides of the lower rib 532*a*. The ventilation portion 502 includes an upper rib 532*c* protruding the outside from an upper portion of the through hole 507. The upper rib 532*c* includes an upper surface portion 532*c*1 corresponding to the uppermost upper side of the through hole 507 and inclined portions 532*c*2 inclined so as to correspond to sides connected to both sides of the upper side.

The side rib 532*b* extends higher upward than the upper rib 532*c*. The lower rib 532*a* (side rib 532*b*) is configured to further protrude the outside from an outer surface of the housing 210 than the upper rib 532*c*.

Hereinafter, a modified example of the ventilation portion will be described with reference to FIGS. 18 through 23.

Figure 18:
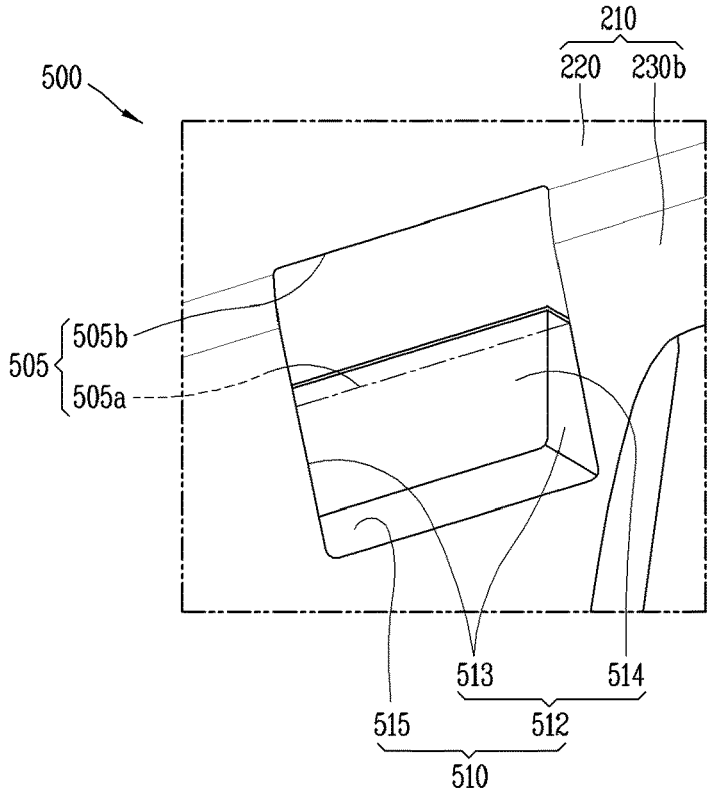
FIG. 18 is a modified example illustrating the ventilation portion of the housing in FIG. 2.
Figure 19:
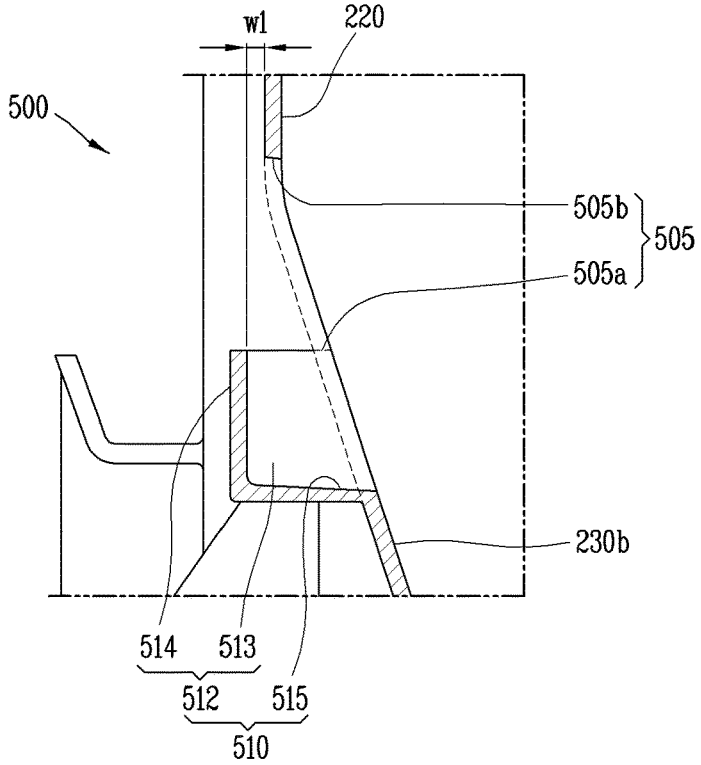
FIG. 19 is a longitudinal sectional view illustrating the ventilation portion in FIG. 18.

FIG. 18 is a modified example illustrating the ventilation portion 500 of the housing 210 in FIG. 2, and FIG. 19 is a longitudinal sectional view illustrating the ventilation portion 500 in FIG. 18. As illustrated in FIG. 18, the ventilation portion 500 of the present embodiment includes a through hole 505 formed through the housing 210 and a protruding groove portion 510 that protrudes to the outside and communicates with the inside at a lower side of the through hole 505.

The through hole 505 is implemented, for example, in a rectangular shape. The upper side 505*b* of the through hole 505 is formed in the vertical section 220 of the housing 210. The lower side 505*a* of the through hole 505 is formed in an inclined section (second inclined section 230*b*) of the housing 210. The lower side of the through hole 505 is not shown in detail, but may be shown as an imaginary line.

The protruding groove portion 510 may be provided at a lower side of the upper side 505*b* of the through hole 505. The protruding groove portion 510 is disposed with an open lower side. As a result, wash water dropping from the upper side 505*b* of the through hole 505 may drop into the protruding groove portion 510. The protruding groove portion 510 is recessed from an inner surface of the housing 210 and protrudes from an outer surface of the housing 210. The protruding groove portion 510 is implemented in a "U" cross-sectional shape that is open to an inside of the housing 210. The protruding groove portion 510 includes a plurality of side surface portions 512 and a bottom surface portion 515 blocks a bottom portion of the plurality of side surface portions 512.

The plurality of side surface portions 512 include both side surface portion 513 protruding to the outside from an outer surface of the housing 210 and a connection portion 514 connecting the both side surface portions 513. An upper end of the both side portions 513 is connected to the lower side 505*a* of the through hole 505.

As illustrated in FIG. 19, an upper end of the protruding groove portion 510 further protrudes to an outside of the housing 210 at a predetermined width (w1) than the upper side 505*b* of the through hole 505. As a result, when wash water moving downward along the vertical section 220 of the housing 210 drops from the upper side 505*b* of the through hole 505, the possibility of flowing into the protruding groove portion 510 may be increased. As a result, the leakage of wash water dropping to an outside of the housing 210 through the through hole 505 may be reduced.

An inner width between both side surface portions 513 of the protruding groove portion 510 is larger than a length of the upper side 505*b* of the through hole 505 by a predetermined width. As a result, the possibility of allowing wash water dropping from the upper side 505*b* of the through hole 505 to drop into the protruding groove portion 510 may be further increased. As a result, wash water dropping to an outside of the housing 210 through the through hole 505 and leaking to the outside of the housing 210 may be further reduced.

By this configuration, part of wash water dropping along the vertical section 220 of the housing 210 may drop from the upper side 505*b* of the through hole 505 to an outside of the through hole 505. At this time, since the protruding groove portion 510 further protrudes to the outside than the upper side 505*b* of the through hole 505, wash water dropping from the upper side 505*b* of the through hole 505 is more effectively collected. As a result, wash water dropping to the outside through the through hole 505 may be reduced.

Figure 20:
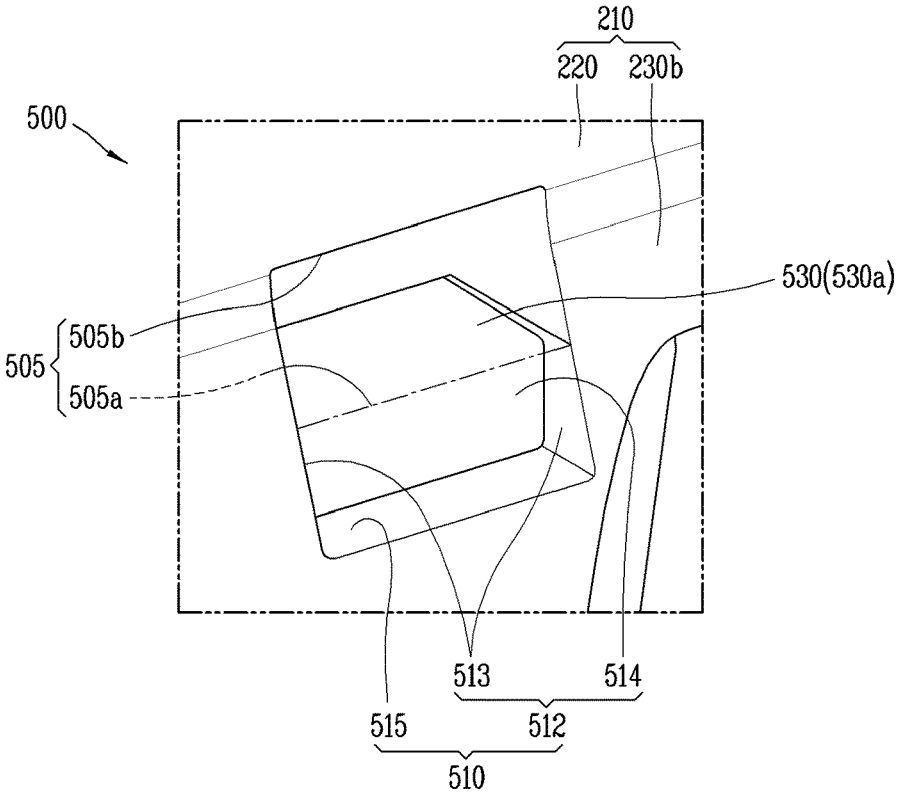
FIG. 20 is a modified example illustrating the ventilation portion of the housing in FIG. 2.
Figure 21:
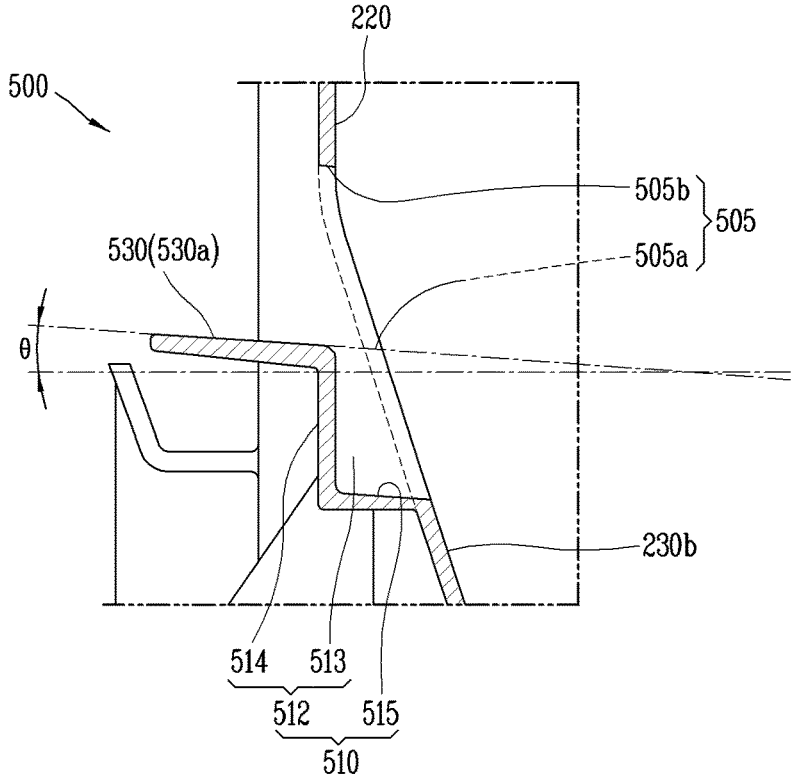
FIG. 21 is a longitudinal sectional view illustrating the ventilation portion in FIG. 20.

FIG. 20 is a modified example illustrating the ventilation portion 500 of the housing 210 in FIG. 2, and FIG. 21 is a longitudinal sectional view illustrating the ventilation portion 500 in FIG. 20. As illustrated in FIG. 20, the ventilation portion 500 of the present embodiment includes a through hole 505 formed through the housing 210 and a protruding groove portion 510 that protrudes to the outside and communicates with the inside at a lower side of the through hole 505.

The through hole 505 is implemented, for example, in a rectangular shape. An upper side of the through hole 505 is disposed in the vertical section 220 of the housing 210, and a lower side of the through hole 505 is disposed in the inclined section 230 (second inclined section 230*b*) of the housing 210.

The protruding groove portion 510 is disposed at a lower side of the upper side 505*b* of the through hole 505. The protruding groove portion 510 includes a plurality of side surface portions 512 extending downward and a bottom surface portion 515 blocking a lower end of the plurality of side surface portions 512 at a lower side of the through hole 505. The protruding groove portion 510 has an open shape to the upper and inner sides of the housing 210, respectively.

On the other hand, the ventilation portion 500 includes a leakage suppression rib 530 protruding to an outside of the housing 210 at an edge of the through hole 505.

The leakage suppression rib 530 includes a lower rib 530*a* extending from a lower side of the through hole 505 to an outside of the housing 210.

The lower rib 530*a* is inclined with a preset inclination angle (θ) with respect to a horizontal line in parallel to a bottom surface on which the laundry treating apparatus is provided. Here, the lower rib 530*a* may be disposed horizontally, and an upper surface of the upper rib 530*a* may be configured to have the inclination angle (θ).

Here, an upper end of the protruding groove portion 510 is configured to be disposed at a lower side of the upper side 505*b* of the through hole 505. In the present embodiment, the lower rib 530*a* protruding to the outside from a lower side of the through hole 505 is provided, and thus an upper end of the protruding groove portion 510 is not required to further protrude to an outside of the housing 210 compared to an upper side of the through hole 505.

By this configuration, part of wash water moving downward along an inner surface of the vertical section 220 of the housing 210 may drop from an upper side of the through hole 505 to an outside of the housing 210. At this time, the lower rib 530*a* blocks (collects) wash water dropping to an outside of the housing 210 through the through hole 505 to move the wash water to an inside of the housing 210. As a result, wash water dropping to an outside of the housing 210 through the through hole 505 may be reduced.

Figure 22:
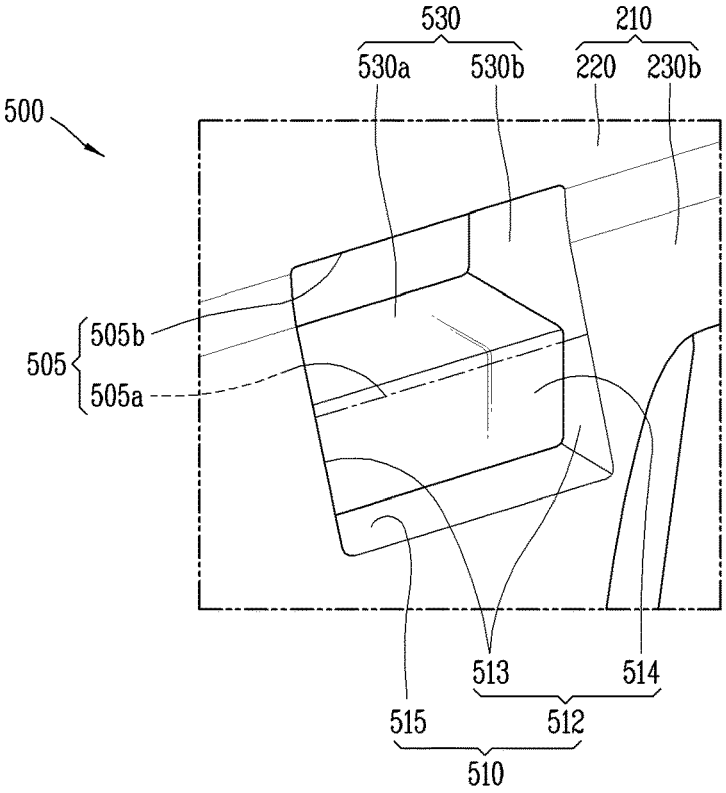
FIG. 22 is a modified example illustrating the ventilation portion of the housing in FIG. 2.
Figure 23:
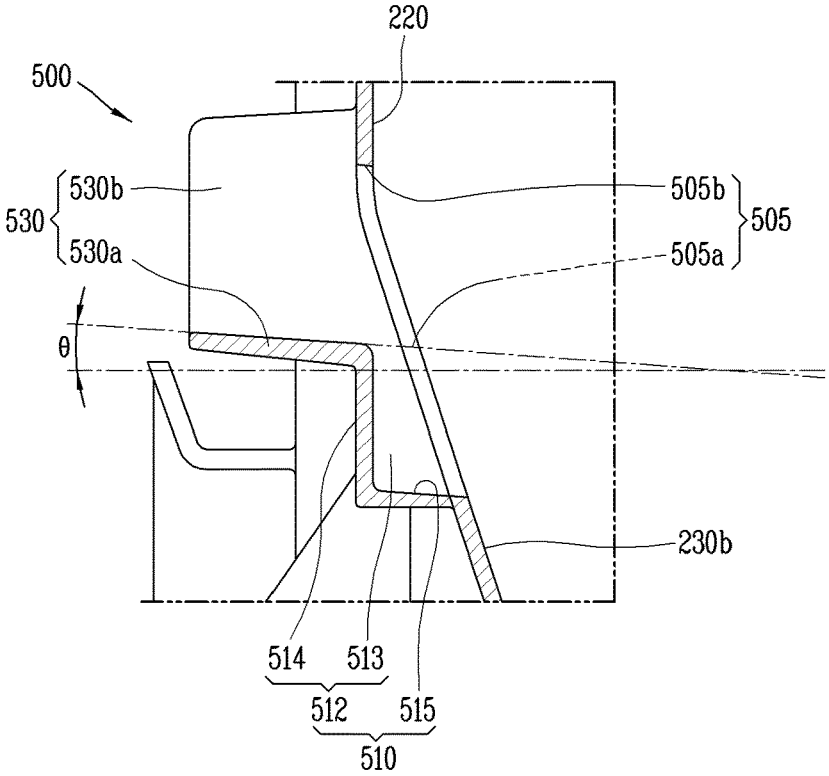
FIG. 23 is a longitudinal sectional view illustrating the ventilation portion in FIG. 22.

FIG. 22 is a modified example illustrating the ventilation portion 500 of the housing 210 in FIG. 2, and FIG. 23 is a longitudinal sectional view illustrating the ventilation portion 500 in FIG. 22. As illustrated in FIG. 22, the ventilation portion 500 of the present embodiment includes a through hole 505 formed through the housing 210 and a protruding groove portion 510 that protrudes to the outside and communicates with the inside at a lower side of the through hole 505.

The through hole 505 is implemented, for example, in a rectangular shape. The upper side 505*b* of the through hole 505 is disposed in the vertical section 220 of the housing 210, and the lower side 505*a* of the through hole 505 is disposed in the inclined section 230 (second inclined section 230*b*) of the housing 210.

The protruding groove portion 510 is disposed at a lower side of the upper side 505*b* of the through hole 505. The protruding groove portion 510 is provided with a plurality of side surface portions 512 and a bottom surface portion 515 blocking a lower end of the plurality of side surface portions 512. The protruding groove portion 510 has an open shape to the upper and inner sides of the housing 210, respectively.

On the other hand, the ventilation portion 500 includes a leakage suppression rib 530 protruding to an outside of the housing 210 at an edge of the through hole 505. The leakage suppression rib 530 includes a lower rib 530*a* extending from a lower side of the through hole 505 to an outside of the housing 210 and side ribs 530*b* extending upward from both sides of the lower rib 530*a*.

The lower rib 530*a* is inclined with a preset inclination angle (θ) with respect to a horizontal line in parallel to a bottom surface on which the laundry treating apparatus is provided.

The side ribs 530*b* are disposed at both sides of the lower rib 530*a*, respectively, to extend upward.

The side ribs 530*b* may extend upward than the upper side 505*b* of the through hole 505.

By this configuration, part of wash water moving downward along an inner surface of the vertical section 220 of the housing 210 may drop from an upper side of the through hole 505 to an outside of the housing 210. At this time, the lower rib 530*a* blocks (collects) wash water dropping to an outside of the housing 210 through the through hole 505 to move the wash water to an inside of the housing 210. As a result, wash water dropping to an outside of the housing 210 through the through hole 505 may be reduced.

Furthermore, part of wash water scattered to an outside of the housing 210 through the through hole 505 from an inside of the housing 210 is blocked by the lower rib 530*a* and the side ribs, and wash water blocked by the lower rib 530*a* and the side ribs 530*b* is moved into the housing 210 by the lower rib 530*a*. As a result, wash water scattered and leaked to the outside through the through hole 505 inside the housing 210 may be reduced.

In the above, preferred embodiments of the present disclosure are illustrated and described herein with reference to the accompanying drawings. However, the present disclosure may be implemented in various embodiments without departing from the concept or gist of the invention, and thus the foregoing embodiments should not be limited to the content of the detailed description.

Furthermore, the foregoing embodiments should be broadly construed within the scope of the technical concept defined by the appended claims even though they are not specifically disclosed in the detailed description herein. Moreover, all changes and modifications within the technical scope of the claims and the equivalent scope thereof should be construed to be included in the appended claims.

What is claimed is:

1. A laundry treating apparatus, comprising:

a cabinet;

a water tank that is disposed inside the cabinet; and a detergent box that is in communication with the water tank and that is configured to supply detergent to an inside of the water tank, the detergent box comprising:

a housing that is in communication with the water tank, a drawer configured to be received inside the housing, and a ventilation portion that is defined through the housing and that allows the inside of the water tank to communicate with an outside of the housing, wherein the ventilation portion includes:

a through hole that extends through a side surface of the housing, and a protruding groove portion that is disposed vertically below the through hole, that is recessed from an inner surface of the housing toward an outside of the housing, and that protrudes from an outer surface of the housing, the protruding groove portion having an upper side that is open to the through hole and an inner side that is open to an inside of the housing.

2. The laundry treating apparatus of claim 1, wherein the protruding groove portion further protrudes toward the outside of the housing relative to an upper portion of the through hole.

3. The laundry treating apparatus of claim 1, wherein the protruding groove portion protrudes outward from the outer surface of the housing relative to the through hole, and extends inward relative to the through hole.

4. The laundry treating apparatus of claim 1, wherein the ventilation portion further comprises a leakage suppression rib that extends along an edge of the through hole and that protrudes to the outside of the housing.

5. The laundry treating apparatus of claim 1, wherein the housing comprises:

a vertical section that faces both sides of the drawer received in the housing; and an inclined section that extends inward from the vertical section to the inside of the housing and that is inclined with respect to the vertical section, and wherein an upper portion of the through hole is defined in a boundary region between the vertical section and the inclined section, and a lower portion of the through hole is defined in the inclined section.

6. The laundry treating apparatus of claim 5, wherein the through hole has a rectangular shape, and wherein an upper side of the through hole is disposed in the vertical section, and a lower side of the through hole extends along the inclined section.

7. The laundry treating apparatus of claim 5, wherein the protruding groove portion comprises:

a plurality of side surface portions that protrude from the outer surface of the housing, that extend vertically, and that are spaced apart from each other; and a bottom surface portion that connects lower ends of the plurality of side surface portions to each other.

8. The laundry treating apparatus of claim 5, wherein the ventilation portion further comprises a lower rib that protrudes from a bottom portion of the through hole to the outside of the housing.

9. The laundry treating apparatus of claim 8, wherein the lower rib has a rectangular plate shape.

10. The laundry treating apparatus of claim 9, wherein the ventilation portion further comprises side ribs that extend upward from both sides of the lower rib, respectively.

11. The laundry treating apparatus of claim 10, wherein the ventilation portion further comprises an upper rib that protrudes to the outside of the housing from an upper side of the through hole.

12. The laundry treating apparatus of claim 11, wherein each of the side ribs extends upward from the upper rib.

13. The laundry treating apparatus of claim 11, wherein the lower rib further protrudes to the outside of the housing relative to the upper rib.

14. The laundry treating apparatus of claim 5, wherein the through hole has a circular shape.

15. The laundry treating apparatus of claim 14, wherein the ventilation portion comprises a lower rib that protrudes to the outside of the housing from a bottom portion of the through hole, and wherein both sides of the lower rib extend vertically above a center of the through hole.

16. The laundry treating apparatus of claim 5, wherein the through hole has a hexagonal shape.

17. The laundry treating apparatus of claim 16, wherein the ventilation portion comprises a lower rib that protrudes to the outside of the housing from a bottom portion of the through hole, and wherein both sides of the lower rib are inclined with respect to the bottom portion of the through hole and protrude upward relative to a center of the through hole.

18. The laundry treating apparatus of claim 8, wherein the lower rib has an upper surface that is inclined with respect to the bottom portion of the through hole and that downwardly extends to the inside of the housing.

19. The laundry treating apparatus of claim 1, wherein the drawer has a plurality of detergent receiving spaces defined therein, and wherein the detergent box further comprises a dispensing unit disposed at an upper side of the drawer and configured to dispense wash water to the plurality of detergent receiving spaces.

20. The laundry treating apparatus of claim 1, wherein the housing defines a through portion at a bottom portion of the housing, and wherein the laundry treating apparatus further comprises a wash water supply pipe having a first end that is in communication with the through portion of the housing and a second end that is in communicate with the water tank.

* * * * *